US007243537B2

(12) United States Patent
Proett et al.

(10) Patent No.: US 7,243,537 B2
(45) Date of Patent: Jul. 17, 2007

(54) METHODS FOR MEASURING A FORMATION SUPERCHARGE PRESSURE

(75) Inventors: Mark A. Proett, Missouri City, TX (US); Wilson Chung-Ling Chin, Houston, TX (US); Jean Michel Beique, Katy, TX (US); John R. Hardin, Jr., Spring, TX (US); James M. Fogal, Houston, TX (US); David Welshans, Damon, TX (US); Glenn C. Gray, Austin, TX (US)

(73) Assignee: Halliburton Energy Services, Inc, Houston, TX (US)

( * ) Notice: Subject to any disclaimer, the term of this patent is extended or adjusted under 35 U.S.C. 154(b) by 111 days.

(21) Appl. No.: 11/069,649

(22) Filed: Mar. 1, 2005

(65) Prior Publication Data

US 2005/0235745 A1 Oct. 27, 2005

Related U.S. Application Data

(60) Provisional application No. 60/573,370, filed on May 21, 2004, provisional application No. 60/549,092, filed on Mar. 1, 2004.

(51) Int. Cl.
*E21B 47/06* (2006.01)

(52) U.S. Cl. ..... 73/152.51

(58) Field of Classification Search ..... 73/152.02, 73/152.05, 152.17, 152.51
See application file for complete search history.

(56) References Cited

U.S. PATENT DOCUMENTS 3,173,485 A 3/1965 Bretzke, Jr.
3,338,307 A 8/1967 Redwine (Continued)

FOREIGN PATENT DOCUMENTS

EP 0697501 A2 2/1996

(Continued)

OTHER PUBLICATIONS

Proett et al., "Supercharge Pressure Compensation Using a New Wireline Testing Method and Newly Developed Early Time Spherical Flow Model," 1996, Society of Petroleum Engineers, SPE 36524, pp. 329-342.*

(Continued)

*Primary Examiner*—Hezron Williams
*Assistant Examiner*—John Fitzgerald
(74) *Attorney, Agent, or Firm*—Conley Rose, P.C.

(57) ABSTRACT

A method of determining the supercharge pressure in a formation intersected by a borehole having a wall, the method comprising disposing a formation pressure test tool into the borehole having a probe for isolating a portion of the borehole. The method further comprises extending the probe into sealing contact with the borehole wall. The method further comprises performing at least one drawdown test with the formation pressure test tool. The method further comprises modeling the supercharge pressure of the formation using the dynamic properties of the mudcake. The method further comprises determining the supercharge pressure of the formation using the supercharge pressure model. The formation pressure test tool may be conveyed into the borehole using wireline technology or on a drill string. Using the supercharge pressure, the drawdown test may be optimized, the characteristics of the drilling fluid altered, or the measurements of other sensors adjusted.

26 Claims, 14 Drawing Sheets

U.S. PATENT DOCUMENTS

| | | | | |
|---|---|---|---|---|
| 3,356,137 | A | | 12/1967 | Raugust |
| 3,530,933 | A | | 9/1970 | Whitten |
| 3,565,169 | A | | 2/1971 | Bell |
| 3,811,321 | A | | 5/1974 | Urbanosky |
| 3,813,936 | A | | 6/1974 | Urbanosky et al. |
| 3,858,445 | A | | 1/1975 | Urbanosky |
| 3,859,850 | A | | 1/1975 | Whitten et al. |
| 3,859,851 | A | | 1/1975 | Urbanosky |
| 3,864,970 | A | | 2/1975 | Bell |
| 3,924,463 | A | | 12/1975 | Urbanosky |
| 3,934,468 | A | | 1/1976 | Brieger |
| 3,952,588 | A | | 4/1976 | Whitten |
| 4,210,018 | A | | 7/1980 | Brieger |
| 4,246,782 | A | | 1/1981 | Hallmark |
| 4,248,081 | A | | 2/1981 | Hallmark |
| 4,270,385 | A | | 6/1981 | Hallmark |
| 4,282,750 | A | | 8/1981 | Prats et al. |
| 4,287,946 | A | | 9/1981 | Brieger |
| 4,292,842 | A | | 10/1981 | Hallmark |
| 4,339,948 | A | | 7/1982 | Hallmark |
| 4,375,164 | A | | 3/1983 | Dodge et al. |
| 4,416,152 | A | | 11/1983 | Wilson |
| 4,434,653 | A | | 3/1984 | Montgomery |
| 4,507,957 | A | | 4/1985 | Montgomery et al. |
| 4,513,612 | A | | 4/1985 | Shalek |
| 4,593,560 | A | | 6/1986 | Purfurst |
| 4,671,322 | A | | 6/1987 | Purfurst |
| 4,712,613 | A | | 12/1987 | Nieuwstad |
| 4,720,996 | A | | 1/1988 | Marsden et al. |
| 4,742,459 | A | | 5/1988 | Lasseter |
| 4,745,802 | A | | 5/1988 | Purfurst |
| 4,782,695 | A | | 11/1988 | Glotin et al. |
| 4,833,914 | A | | 5/1989 | Rasmus |
| 4,843,878 | A | | 7/1989 | Purfurst et al. |
| 4,845,982 | A | | 7/1989 | Gilbert |
| 4,860,580 | A | | 8/1989 | DuRocher |
| 4,860,581 | A | | 8/1989 | Zimmerman et al. |
| 4,862,967 | A | | 9/1989 | Harris |
| 4,879,900 | A | | 11/1989 | Gilbert |
| 4,884,439 | A | | 12/1989 | Baird |
| 4,890,487 | A | | 1/1990 | Dussan V. et al. |
| 4,893,505 | A | | 1/1990 | Marsden et al. |
| 4,936,139 | A | | 6/1990 | Zimmerman et al. |
| 4,941,350 | A | | 7/1990 | Schneider |
| 4,949,575 | A | | 8/1990 | Rasmus |
| 4,951,749 | A | | 8/1990 | Carroll |
| 4,962,665 | A | | 10/1990 | Savage et al. |
| 4,994,671 | A | | 2/1991 | Safinya et al. |
| 5,056,595 | A | | 10/1991 | Desbrandes |
| 5,095,745 | A | * | 3/1992 | Desbrandes ..... 73/152.24 |
| 5,148,705 | A | | 9/1992 | Desbrandes |
| 5,166,747 | A | | 11/1992 | Schroeder et al. |
| 5,167,149 | A | | 12/1992 | Mullins et al. |
| 5,184,508 | A | * | 2/1993 | Desbrandes ..... 73/152.05 |
| 5,201,220 | A | | 4/1993 | Mullins et al. |
| 5,207,104 | A | | 5/1993 | Enderlin |
| 5,230,244 | A | | 7/1993 | Gilbert |
| 5,233,866 | A | * | 8/1993 | Desbrandes ..... 73/152.05 |
| 5,247,830 | A | | 9/1993 | Goode |
| 5,265,015 | A | | 11/1993 | Auzerais et al. |
| 5,269,180 | A | | 12/1993 | Dave et al. |
| 5,279,153 | A | | 1/1994 | Dussan V. et al. |
| 5,303,582 | A | | 4/1994 | Miska |
| 5,303,775 | A | | 4/1994 | Michaels et al. |
| 5,329,811 | A | | 7/1994 | Schultz et al. |
| 5,335,542 | A | | 8/1994 | Ramakrishnan et al. |
| 5,353,637 | A | | 10/1994 | Plumb et al. |
| 5,377,755 | A | | 1/1995 | Michaels et al. |
| 5,473,939 | A | | 12/1995 | Leder et al. |
| 5,517,854 | A | | 5/1996 | Plumb et al. |
| 5,549,159 | A | | 8/1996 | Shwe et al. |
| 5,549,162 | A | | 8/1996 | Moody et al. |
| 5,587,525 | A | | 12/1996 | Shwe et al. |
| 5,602,334 | A | * | 2/1997 | Proett et al. ..... 73/152.05 |
| 5,622,223 | A | | 4/1997 | Vasquez |
| 5,635,631 | A | | 6/1997 | Yesudas et al. |
| 5,644,076 | A | * | 7/1997 | Proett et al. ..... 73/152.41 |
| 5,663,559 | A | | 9/1997 | Auzerais et al. |
| 5,672,819 | A | | 9/1997 | Chin et al. |
| 5,703,286 | A | | 12/1997 | Proett et al. |
| 5,708,204 | A | | 1/1998 | Kasap |
| 5,741,962 | A | | 4/1998 | Birchak et al. |
| 5,770,798 | A | | 6/1998 | Georgi et al. |
| 5,789,669 | A | * | 8/1998 | Flaum ..... 73/152.51 |
| 5,803,186 | A | | 9/1998 | Berger et al. |
| 5,934,374 | A | | 8/1999 | Hrametz et al. |
| 5,969,241 | A | | 10/1999 | Auzerais |
| 6,026,915 | A | | 2/2000 | Smith et al. |
| 6,047,239 | A | | 4/2000 | Berger et al. |
| 6,058,773 | A | | 5/2000 | Zimmerman et al. |
| 6,092,416 | A | | 7/2000 | Halford et al. |
| 6,111,409 | A | | 8/2000 | Edwards et al. |
| 6,128,949 | A | | 10/2000 | Kleinberg |
| 6,157,893 | A | | 12/2000 | Berger et al. |
| 6,164,126 | A | | 12/2000 | Ciglenec et al. |
| 6,178,815 | B1 | | 1/2001 | Felling et al. |
| 6,223,822 | B1 | | 5/2001 | Jones |
| 6,230,557 | B1 | | 5/2001 | Ciglenec et al. |
| 6,247,542 | B1 | | 6/2001 | Kruspe et al. |
| 6,274,865 | B1 | | 8/2001 | Schroer et al. |
| 6,301,959 | B1 | | 10/2001 | Hrametz et al. |
| 6,334,489 | B1 | | 1/2002 | Shwe et al. |
| 6,343,507 | B1 | | 2/2002 | Felling et al. |
| 6,350,986 | B1 | | 2/2002 | Mullins et al. |
| 6,388,251 | B1 | | 5/2002 | Papanyan |
| 6,415,648 | B1 | | 7/2002 | Peeters |
| 6,427,530 | B1 | | 8/2002 | Krueger et al. |
| 6,439,307 | B1 | | 8/2002 | Reinhardt |
| 6,446,736 | B1 | | 9/2002 | Kruspe et al. |
| 6,474,152 | B1 | | 11/2002 | Mullins et al. |
| 6,476,384 | B1 | | 11/2002 | Mullins et al. |
| 6,478,096 | B1 | | 11/2002 | Jones et al. |
| 6,513,606 | B1 | | 2/2003 | Krueger |
| 6,516,898 | B1 | | 2/2003 | Krueger |
| 6,568,487 | B2 | | 5/2003 | Meister et al. |
| RE38,129 | E | | 6/2003 | Kleinberg |
| 6,581,455 | B1 | | 6/2003 | Berger et al. |
| 6,585,045 | B2 | | 7/2003 | Lee et al. |
| 6,609,568 | B2 | | 8/2003 | Krueger et al. |
| 6,637,524 | B2 | | 10/2003 | Kruspe et al. |
| 6,640,908 | B2 | | 11/2003 | Jones et al. |
| 6,655,458 | B2 | | 12/2003 | Kurkjian et al. |
| 6,658,930 | B2 | | 12/2003 | Abbas |
| 6,659,177 | B2 | | 12/2003 | Bolze et al. |
| 6,668,924 | B2 | | 12/2003 | Bolze et al. |
| 6,672,386 | B2 | | 1/2004 | Krueger et al. |
| 6,688,390 | B2 | | 2/2004 | Bolze et al. |
| 6,719,049 | B2 | | 4/2004 | Sherwood et al. |
| 6,729,399 | B2 | | 5/2004 | Follini et al. |
| 6,745,835 | B2 | | 6/2004 | Fields |
| 6,748,328 | B2 | | 6/2004 | Storm, Jr. et al. |
| 6,758,090 | B2 | | 7/2004 | Bostrom et al. |
| 6,763,884 | B2 | | 7/2004 | Meister et al. |
| 6,768,105 | B2 | | 7/2004 | Mullins et al. |
| 6,769,296 | B2 | | 8/2004 | Montalvo et al. |
| 6,786,086 | B2 | | 9/2004 | Hashem |
| 6,799,117 | B1 | | 9/2004 | Proett et al. |
| 6,825,657 | B2 | | 11/2004 | Kleinberg et al. |
| 6,832,515 | B2 | | 12/2004 | Follini et al. |
| 2001/0035289 | A1 | | 11/2001 | Runia |
| 2002/0046835 | A1 | | 4/2002 | Lee et al. |
| 2002/0060094 | A1 | | 5/2002 | Meister et al. |
| 2002/0084072 | A1 | | 7/2002 | Bolze et al. |
| 2002/0112854 | A1 | | 8/2002 | Krueger et al. |

| | | | | |
|---|---|---|---|---|
| 2002/0129936 | A1 | 9/2002 | Cernosek | |
| 2002/0185313 | A1 | 12/2002 | Jones et al. | |
| 2002/0189338 | A1 | 12/2002 | Kruspe et al. | |
| 2002/0189339 | A1 | 12/2002 | Montalvo et al. | |
| 2003/0042021 | A1 | 3/2003 | Bolze et al. | |
| 2003/0062472 | A1 | 4/2003 | Mullins et al. | |
| 2003/0066646 | A1 | 4/2003 | Shammai et al. | |
| 2003/0146022 | A1 | 8/2003 | Krueger | |
| 2003/0167834 | A1 | 9/2003 | Weintraub et al. | |
| 2003/0214879 | A1 | 11/2003 | Proett et al. | |
| 2003/0226663 | A1 | 12/2003 | Krueger et al. | |
| 2004/0007058 | A1 | 1/2004 | Rylander et al. | |
| 2004/0011525 | A1 | 1/2004 | Jones et al. | |
| 2004/0020649 | A1 | 2/2004 | Fields | |
| 2004/0026125 | A1 | 2/2004 | Meister et al. | |
| 2004/0035199 | A1 | 2/2004 | Meister et al. | |
| 2004/0045706 | A1 | 3/2004 | Pop et al. | |
| 2004/0050153 | A1 | 3/2004 | Krueger et al. | |
| 2004/0050588 | A1 | 3/2004 | Follini et al. | |
| 2004/0099443 | A1 | 5/2004 | Meister et al. | |
| 2004/0173351 | A1 | 9/2004 | Fox et al. | |
| 2004/0230378 | A1 | 11/2004 | Proett et al. | |
| 2004/0231408 | A1 | 11/2004 | Shammai | |
| 2004/0231841 | A1 | 11/2004 | Niemeyer et al. | |
| 2004/0231842 | A1 | 11/2004 | Shammai et al. | |
| 2004/0260497 | A1* | 12/2004 | DiFoggio et al. | 702/98 |

FOREIGN PATENT DOCUMENTS

| | | | |
|---|---|---|---|
| EP | 0994238 | A2 | 4/2000 |
| EP | 0978630 | A2 | 9/2002 |
| GB | 2 304 906 | A | 3/1997 |
| WO | WO 01/33044 | A1 | 5/2001 |
| WO | WO 01/33045 | A1 | 5/2001 |
| WO | WO 01/98630 | A1 | 12/2001 |
| WO | WO 02/08570 | A1 | 1/2002 |

OTHER PUBLICATIONS

Sarkar et al., "Adverse Effects of Poor Mud Cake Quality: A Supercharging and Fluid Sampling Study," 1998, Society of Petroleum Engineers, SPE 48958, pp. 1-12.*

Joel L. Hebert; "A Method for Planning and Performing a Pressure Survey to Achieve Desired Accuracy of Pressure Gradient"; 2002 ASME Engineering Technology Conference on Endergy; Feb. 4-5, 2002; pp. 1-8; ETCE 2002; American Society of Mechanical Engineers; Houston, Texas, U.S.A.

A.H. Akram et al.; "A Model to Predict Wireline Formation Tester Sample Contamination"; 1998 SPE Annual Technical Conference and Exhibition; Sep. 27-30, 1998; pp. 27-33; SPE 48959; Society of Petroleum Engineers, Inc.; New Orleans, Louisiana, U.S.A.

R. Desbrandes, et al.; "A New Concept in Wireline Formation Testing: Extended Drawdown," 13th CWLS Formation Evaluation Symp.; 1991; Calgary, Canada; pp. 1-25.

Yi Shaoguo et al., "A New Flow Model of Pressure Response to Wireline Formation Testing"; Journal of Jianghan Petroleum Institute; vol. 19, No. 3; Sep. 1997; pp. 42-45. (Partial translation attached).

E. Kasap; "A New, Simplified, Unified Technique For The Analysis of Wireline Formation Test Data"; SPWLA 37th Annual Logging Symposium; Jun. 16-19, 1996; pp. 1-13.

Kun Huang; "A Study of Dimensionless Parameters and Formation Rate Analysis Technique for Interpretation of WFT Data"; 1996; pp. 1-147; University of Tulsa; Tulsa, Oklahoma, U.S.A.

Mark A. Proett et al.; "Advanced Permeability and Anistropy Measurements While Testing and Sampling in Real-Time Using a Dual Probe Formation Tester"; 2000 SPE Annual Technical Conference and Exhibition; Oct. 1-4, 2000; pp. 1-15; SPE 62919; Society of Petroleum Engineers, Inc.; Dallas, Texas, U.S.A.

Robert C. Earlougher, Jr.; "Advances In Well Test Analysis"; Society of Petroleum Engineers of AIME; 1997; New York, New York, U.S.A. and Dallas, Texas, U.S.A.

Amit K. Sakar et al.; "Adverse Effects of Poor Mud Cake Quality: Supercharging and Fluid Sampling Study"; SPE Reservoir Eval. & Eng. 3 (3), Jun. 2000; pp. 256-262; Society of Petroleum Engineers, Inc.; U.S.A.

E. B. Dussan V. et al.; "An Analysis of the Pressure Response of a Single-Probe Formation Tester"; 62nd Annual Technical Conference and Exhibition; Sep. 27-30, 1987; pp. 519-527; SPE 16801; Society of Petroleum Engineers, Inc.; Dallas, Texas, U.S.A.

A.A. Grinko et al.; "Analysis of the Quality of Drilling-In of Producing Formation on the Basis of the Results of Tests During Drilling"; Stroit. Neft. Gaz. Skvazhin Sushe More; Apr.-May 1999; pp. 45-47; Nos. 4-5; ISSN 0130-3872; Russia.

Ekrem Kasa:; "Analysis of Wireline Formation Test Data From Gas and Non-Darcy Flow Conditions"; 1998 SPE Permian Basin Oil and Gas Recovery Conference; Mar. 25-27, 1998; pp. 183-189; SPE 39769; Society of Petroleum Engineers, Inc.; Midland, Texas, U.S.A.

T. Zimmerman et al.; "Application of Emerging Wireline Formation Testing Technologies"; Eighth Offshore South East Asia Conference; Dec. 4-7, 1990; pp. 83-95; OSEA 90105; Offshore South East Asia; Singapore.

M. Hooper et al.; "Applications for an LWD Formation Tester"; 1999 SPE European Formation Damage Conference; May 28-Jun. 1, 1999; pp. 1-8; SPE 52794; Society of Petroleum Engineers, Inc.; The Hague, The Netherlands.

Cosan Ayan et al.; "Characterizing Permeability with Formation Testers"; Oilfield Review, Autumn 2001; pp. 2-23.

H. Elshahawi et al.; "Correcting for Wettability and Capillary Pressure Effects on Formation Tester Measurements"; SPWLA 41st Annual Logging Symposium; Jun. 4-7, 2000; pp. 1-14; Society of Petroleum Well Log Analysts; Dallas, Texas, U.S.A.

H. Elshahawi et al.; "Correcting for Wettability and Capillary Pressure Effects on Formation Tester Measurements"; 2000 SPE Annual Technical Conference and Exhibition; Oct. 1-4, 2000; pp. 1-15; SPE 63075; Society of Petroleum Engineers, Inc.; Dallas, Texas, U.S.A.

M. D. Enikeev; "Effect of Shaft Curvature on The Results of Formation Testing During the Drilling of Sloping Wells"; May 1978; pp. 26-29; pub. No. 004224; All-Union Sci. Res. Inst of Pet & Geophys. Ind.; USSR. (Partial translation attached).

Jaedong Lee et al.; "Enhanced Wireline Formation Tests in Low-Permeability Formations: Quality Control Through Formation Rate Analysis"; 2000 SPE Rocky Mountain Regional/Low Permeability Reservoirs Symposium and Exhibition; Mar. 12-15, 2000; pp. 1-4 with Figures 1A-15; SPE 60392; Society of Petroleum Engineers Inc.; Denver, Colorado, U.S.A.

H. Badaam et al.; "Estimation of Formation Properties Using Multiprobe Formation Tester in Layered Reservoirs"; 1998 SPE Annual Technical Conference and Exhibition; Sep. 27-30, 1998; pp. 479-490; SPE 49141; Society of Petroleum Engineers, Inc.; New Orleans, Louisiana, U.S.A.

S.W. Burnie, "Estimation of Reservoir Productivity, Fluid Composition, and Reserves in Sour Gas Formations Using the MDT (Modular Formation Dynamics Tester) Tool and a Comparison with the Completed Well Performance"; 1st CSPG/CWLS Exploration, Evaluation & Exploitation Joint Symposium; May 28-31, 1995; 1 p (Abstract Only); Calgary, Canada.

G. D. Sukhonosov; "Evaluation of Permeability Change Around The Well-Bore Area From Data Obtained With Formation Testers"; Neft Khoz; Oct. 1970; pp. 22-26; No. 10; RUSSIA.

I. Gaz et al.; "Exploring New Methodologies To Acquire DST Type Data"; 1997 Offshore Mediterranean Conference and Exhibition; Mar. 19-21, 1997; pp. 587-592; Ravenna, Italy.

R. Desbrandes et al.; "Field Applications of Wireline Formation Testers in Low-Permeability Gas Reservoirs"; 1991 SPE Gas Technology Symposium; Jan. 23-25, 1991; pp. 223-236; SPE 21502; Society of Petroleum Engineers, Inc.; Houston, Texas, U.S.A.

Long Haitao; "Follow-Up Monitoring and Evaluation of the Formation Pressure in the Process of Drilling"; Natur. Gas Ind., vol. 20, No. 4, pp. 33-36; Jul. 25, 2000. (Partial translation attached).

M. Meister et al.; "Formation Pressure Testing During Drilling: Challenges and Benefits"; SPE Annual Technical Conference and Exhibition; Oct. 5-8, 2003; pp. 1-8; SPE 84088; Society of Petroleum Engineers, Inc.; Denver, CO, U.S.A.
Mark Proett et al.; "Formation Pressure Testing In The Dynamic Drilling Environment"; 2004 IADC/SPE Drilling Conference; Mar. 2-4, 2004; pp. 1-11; IADC/SPE 87090; Society of Petroleum Engineers, Inc.; Dallas, Texas, U.S.A.
C. Frimann-Dahl et al.; "Formation Testers vs DST—The Cost Effective Use of Transient Analysis to Get Reservoir Parameters"; 1998 SPE Annual Technical Conference; Sep. 27-30, 1998; pp. 1-14; SPE 48962; Society of Petroleum Engineers, Inc.; New Orleans, Louisiana, U.S.A.
P.S. Varlamov et al.; "Formation Testing During Deep Well Drilling"; 1983; pp. 118-124; No. 39; Russia. (Partial translation attached).
Peter A. Goode et al.; "Influence of an Invaded Zone on a Multiprobe Formation Tester"; SPE Formation Evaluation, Mar. 1996; pp. 31-40.
Alastair Crombie et al.; "Innovations in Wireline Fluid Sampling"; pp. 26-41; Oilfield Review, Autumn 1998.
R. Desbrandes; "Invasion Diameter and Supercharging in Time-Lapse MWD/LWD Logging"; Proceedings, Measurement While Drilling Symposium; Feb. 26-27, 1990; pp. 115-135; Louisiana State University; Baton Rouge, Louisiana, U.S.A.
Mark A. Proett et al.; "Low Permeability Interpretation Using a New Wireline Formation Tester 'Tight Zone' Pressure Transient Analysis"; 1994 SPWLA 35th Annual Logging Symposium; Jun. 19-22, 1994; pp. 1-25.
R. Desbrandes et al.; "Measurement While Drilling"; Studies in Abnormal Pressures. Developments in Petroleum Science, 38; 1994; pp. 251-279; Elsevier Science B.V.
Mark A Proett et al.; "Multiple Factors That Influence Wireline Formation Tester Pressure Measurements and Fluid Contact Estimates"; 2001 SPE Annual Technical Conference and Exhibition; Sep. 30-Oct. 3, 2001; pp. 1-16; SPE 71566; Society of Petroleum Engineers, Inc.; New Orleans, Louisiana, U.S.A.
Mark A. Proett et al.; "New Dual-Probe Wireline Formation Testing and Sampling Tool Enables Real-Time Permeability and Anistropy Measurements"; 2000 SPE Permian Basin Oil and Gas Recovery Conference; Mar. 21-23, 2000; pp. 1-16; SPE 59701; Society of Petroleum Engineers, Inc.; Midland, Texas, U.S.A.
Mark A. Proett et al.; "New Exact Spherical Flow Solution With Storage and Skin For Early-Time Interpretation With Applications to Wireline Formation and Early-Evaluation Drillstem Testing"; 1998 SPE Annual Technical Conference and Exhibition; Sep. 27-30, 1998; pp. 463-478; SPE 49140; Society of Petroleum Engineers, Inc.; New Orleans, Louisiana, U.S.A.
Mark A. Proett et al.; "New Exact Spherical Flow Solution With Storage For Early-Time Interpretation With Applications to Early-Evaluation Drillstem Testing and Wireline Formation Testing"; 1998 SPE Permian Basin Oil and Gas Recovery Conference; Mar. 25-27, 1998; pp. 167-181; SPE 39768; Society of Petroleum Engineers, Inc.; Midland, Texas, U.S.A.
Rob Badry et al.; "New Wireline Formation Tester Techniques and Applications"; 1993 SPWLA Annual Symposium; Jun. 13-16, 1993; pp. 1-15; Calgary, Alberta, Canada.
Mark A. Proett et al.; "New Wireline Formation Testing Tool With Advanced Sampling Technology"; 1999 SPE Annual Technical Conference and Exhibition; Oct. 3-6, 1999; pp. 1-16; SPE 56711; Society of Petroleum Engineers, Inc.; Houston, Texas, U.S.A.
A. F. Shakirov et al.; "On The Regimes of Formation Testing In Wells"; Neft Khoz; Dec. 1973; pp. 14-17; No. 12; RUSSIA.
K. Zainun et al.; "Optimized Exploration Resource Evaluation Using the MDT Tool"; 1995 SPE Asia Pacific Oil and Gas Conference; Mar. 20-22, 1995; pp. 177-194; SPE 29270; Society of Petroleum Engineers, Inc.; Kuala Lumpur, Malaysia.
Jaedong Lee et al.; "Pressure Test Analysis of Gas Bearing Formation"; 1998 SPWLA 39th Annual Logging Symposium; May 26-29, 1998; pp. 1-9.
Mark A. Proett et al.; "Real Time Pressure Transient Analysis Methods Applied to Wireline Formation Test Data"; 69th Annual Technical Conference and Exhibition of the Society of Petroleum Engineers; Sep. 25-28, 1994; pp. 1-16; SPE 28449; Society of Petroleum Engineers, Inc.; New Orleans, Louisiana, U.S.A.
V. D. Banchenko et al.; "Results of Using Strata Testers Mounted on Tubes Lowered Into Boreholes in the Southern Mangyshlak Field"; 1982; pp. 28-29; No. 8; ISSN- 0521-8136; Burenie; Russia (Partial translation attached).
E. Kasap et al.; "Robust and Simple Graphical Solution For Wireline Formation Tests: Combined Drawdown and Buildup Analyses"; 1996 SPE Annual Technical Conference and Exhibition; Oct. 6-9, 1996; pp. 343-357; SPE 36525; Society of Petroleum Engineers, Inc.; Denver, Colorado, U.S.A.
S. Haddad et al.; "So What Is The Reservoir Permeability?"; 2000 SPE Annual Technical Conference and Exhibition; Oct. 1-4, 2000; pp. 1-13; SPE 63138; Society of Petroleum Engineers, Inc.; Dallas, Texas, U.S.A.
P. Cooke-Yarborough; "Some 'Quick-Look' and Wellsite Applications of Wireline Formation Testing Tools With Emphasis on Permeability Indicators as an Aid to Choosing Net Pay Discrimination"; Proceedings Indonesian Petroleum Association; Thirteenth Annual Convention; May 1994; pp. 1-16.
P. S. Lapshin et al.; "Study of the Effect of Variable Inflow on Accuracy of Determining Formation Parameters with Formation Testers"; 1971; pp. 11-14; No. 1; Nefteprom. Delo; Russia. (Partial translation attached).
Mark A. Proett et al.; "Supercharge Pressure Compensation Using a New Wireline Testing Method and Newly Developed Early Time Spherical Flow Model"; 1996 SPE Annual Technical Conference and Exhibition; Oct. 6-9, 1996; pp. 329-342; SPE 36524; Society of Petroleum Engineers, Inc.; Denver, Colorado, U.S.A.
G.D. Phelps et al.; "The Analysis of the Invaded Zone Characteristics and Their Influence on Wireline Log and Well-Test Interpretation"; 1984 Society of Petroleum Engineers of AIME 59th Annual Conference and Exhibition; Sep. 16-19, 1984; pp. 1-10; Tables 1-4; Figures 1-14; SPE 13287; Society of Petroleum Engineers of AIME; Houston, Texas, U.S.A.
D.K. Sethi et al.; "The Formation Multi-Tester: Its Basic Principles and Practical Field Applications"; SPWLA Twenty-First Annual Logging Symposium; Jul. 8-11, 1980; pp. 1-34.
M.M. Kamal et al.; "Use of Transient Testing in Reservoir Management"; University of Tulsa Centennial Pertroleum Engineering Symposium; Aug. 29-31, 1994; pp. 519-531; SPE 28008; Society of Petroleum Engineers; Tulsa, Oklahoma, U.S.A.
"Well Testing Using Wireline Methods"; Schlumberger East Asia Well Evaluation Conference; 1981; pp. 121-144; Singapore.
R. Desbrandes et al.; "Wettability and Productivity Characterization of Low Permeability Gas Formations: Annual Report"; Gas Research Institute; Report GRI-91/0135; Mar. 6, 1991.
T. M. Whittle et al.; "Will Wireline Formation Tests Replace Well Tests?"; 2003 SPE Annual Technical Conference and Exhibition; Oct. 5-8, 2003; pp. 57-58; SPE 84086; Society of Petroleum Engineers, Inc.; Denver, Colorado, U.S.A.
J. Michaels et al.; "Wireline Fluid Sampling"; 1995 SPE Annual Technical Conference and Exhibition; Oct. 22-25, 2005; pp. 871-878; SPE 36010; Society of Petroleum Engineers, Inc.; Dallas, Texas, U.S.A.
E. C. Thomas; "Wireline Formation Tester Data: Fact or Fiction?"; Petrophysics, vol. 41, No. 5, Sep.-Oct. 2000; pp. 375-378.
R. Desbrandes: "Wireline Formation Testing: A New Extended Drawdown Technique"; Petroleum Engineer International; pp. 40-44; May 1991.

* cited by examiner 1
2
3
4
9
8
150
5
6
10
13
151
1
11

METHODS FOR MEASURING A FORMATION SUPERCHARGE PRESSURE

CROSS-REFERENCE TO RELATED APPLICATIONS

The present application claims the benefit of 35 U.S.C. 119(e) from U.S. Provisional Application Ser. No. 60/573,370, filed May 21, 2004 and entitled "Apparatus and Methods for Measuring a Formation Supercharge Pressure" and U.S. Provisional Patent Application No. 60/549,092, filed Mar. 1, 2004 and entitled "Formation Testing While Drilling Tool", all hereby incorporated herein by reference for all purposes.

STATEMENT REGARDING FEDERALLY SPONSORED RESEARCH OR DEVELOPMENT

Not Applicable.

BACKGROUND

During the drilling and completion of oil and gas wells, it may be necessary to engage in ancillary operations, such as monitoring the operability of equipment used during the drilling process or evaluating the production capabilities of formations intersected by the wellbore. For example, after a well or well interval has been drilled, zones of interest are often tested to determine various formation properties such as permeability, fluid type, fluid quality, formation temperature, formation pressure, bubblepoint, formation pressure gradient, mobility, filtrate viscosity, spherical mobility, coupled compressibility porosity, skin damage (which is an indication of how the mud filtrate has changed the permeability near the wellbore), and anisotropy (which is the ratio of the vertical and horizontal permeabilities). These tests are performed in order to determine whether commercial exploitation of the intersected formations is viable and how to optimize production.

Wireline formation testers (WFT) and drill stem testers (DST) have been commonly used to perform these tests. The basic DST tool consists of a packer or packers, valves, or ports that may be opened and closed from the surface, and one or more pressure-recording devices. The tool is lowered on a work string to the zone to be tested. The packer or packers are set, and drilling fluid is evacuated to isolate the zone from the drilling fluid column. The valves or ports are then opened to allow flow from the formation to the tool for testing while the recorders chart the pressure transients. A sampling chamber traps formation fluid at the end of the test. WFTs generally employ the same testing techniques but use a wireline to lower the test tool into the borehole after the drill string has been retrieved from the borehole. The WFT typically uses packers also, although the packers typically isolate a much smaller borehole area, compared to DSTs, for more efficient formation testing. In most cases, the WFT do not use conventional packers but rather probe devices that isolate only a small circular region on the borehole wall.

The WFT probe assembly engages the borehole wall and acquires formation fluid samples. The probe assembly may include an isolation pad to engage the borehole wall. The isolation pad seals against the formation and around a hollow probe, which places an internal cavity in fluid communication with the formation. This creates a fluid pathway that allows formation fluid to flow between the formation and the formation tester while isolated from the borehole fluid.

In order to acquire a useful sample, the probe must stay isolated from the relative high pressure of the borehole fluid. Therefore, the integrity of the seal that is formed by the isolation pad is critical to the performance of the tool. If the borehole fluid is allowed to leak into the collected formation fluid, a non-representative sample and pressure measurement will be obtained and the test will have to be repeated.

Examples of isolation pads and probes used in WFTs can be found in Halliburton's DT, SFTT, SFT4, and RDT tools. Isolation pads that are used with WFTs are typically rubber pads affixed to the end of the extending sample probe. The rubber is normally affixed to a metallic plate that provides support to the rubber as well as a connection to the probe. These rubber pads are often molded to fit within the specific diameter hole in which they will be operating.

With the use of WFTs and DSTs, the drill string with the drill bit must first be retracted from the borehole. Then, a separate work string containing the testing equipment, or, with WFTs, the wireline tool string, must be lowered into the well to conduct secondary operations.

DSTs and WFTs may also cause tool sticking or formation damage. Sticking occurs when the tool's body contacts the borehole for an extended period of time. A seal is formed and the differential pressure between the borehole and the formation draws the tool in close contact with the formation and causes the tool to be stuck. Formation damage occurs due to the extended periods the borehole is in the presence of hydrostatic pressures causing drilling fluid invasion to continue. There may also be difficulties of running WFTs in highly deviated and extended reach wells. When sticking or tight sections are encountered only the wireline can be used to retrieve the stuck tool. WFTs also do not have flowbores for the flow of drilling mud that helps prevent sticking. WFTs are also not designed to withstand drilling loads such as torque and weight on bit.

Further, the formation pressure measurement accuracy of drill stem tests and, especially, of wireline formation tests may be affected by mud filtrate invasion and mudcake buildup because significant amounts of time may have passed before a DST or WFT engages the formation after the borehole has been drilled. Mud filtrate invasion occurs when the drilling mud fluids displace formation fluid. Because the mud filtrate ingress into the formation begins at the borehole surface, it is most prevalent there and generally decreases further into the formation. When filtrate invasion occurs, it may become impossible to obtain a representative sample of formation fluid or, at a minimum, the duration of the sampling period must be increased to first remove the drilling fluid and then obtain a representative sample of formation fluid. Mudcake buildup occurs when any solid particles in the drilling fluid are plastered to the side of the wellbore by the circulating drilling mud during drilling. This mudcake helps to isolate and impede the invasion. Frequently, the mud filtrate carries particles into the formation pore spaces, significantly reducing the permeability near the borehole surface. Thus there may be a "skin effect". Because formation testers' pressure transient can only extend relatively short distances into the formation, the measurement of formation permeability can be distorted. The skin effect also reduces the flow rate into the tool thereby impeding the tester's ability to obtain a representative sample of formation fluid. While the mudcake also acts as a region of reduced permeability adjacent to the borehole, it is essential to reducing filtrate invasion. Essentially, the mudcake is the primary seal and aids in obtaining accurate reservoir pressure measurements and formation samples. Normally the mudcake is easily penetrated by WFT probes and zones isolated with inflatable packers. However, the internal skin can reduce the tester's abilities.

Another testing apparatus is the formation tester while drilling (FTWD) tool. Typical FTWD formation testing equipment is suitable for integration with a drill string during drilling operations. Various devices or systems are used for isolating a formation from the remainder of the borehole, drawing fluid from the formation, and measuring physical properties of the fluid and the formation. Fluid properties, among other items, may include fluid compressibility, flowline fluid compressibility, density, viscosity, resistivity, composition, and bubblepoint. For example, the FTWD may use a probe similar to a WFT that extends to the formation and a small sample chamber to draw in formation fluid through the probe to test the formation pressure. To perform a test, the drill string is stopped from rotating and moving axially and the test procedure, similar to a WFT described above, is performed.

BRIEF DESCRIPTION OF THE DRAWINGS

For a more detailed description of the embodiments, reference will now be made to the following accompanying drawings.

DETAILED DESCRIPTION OF THE EMBODIMENTS

Figure 1:
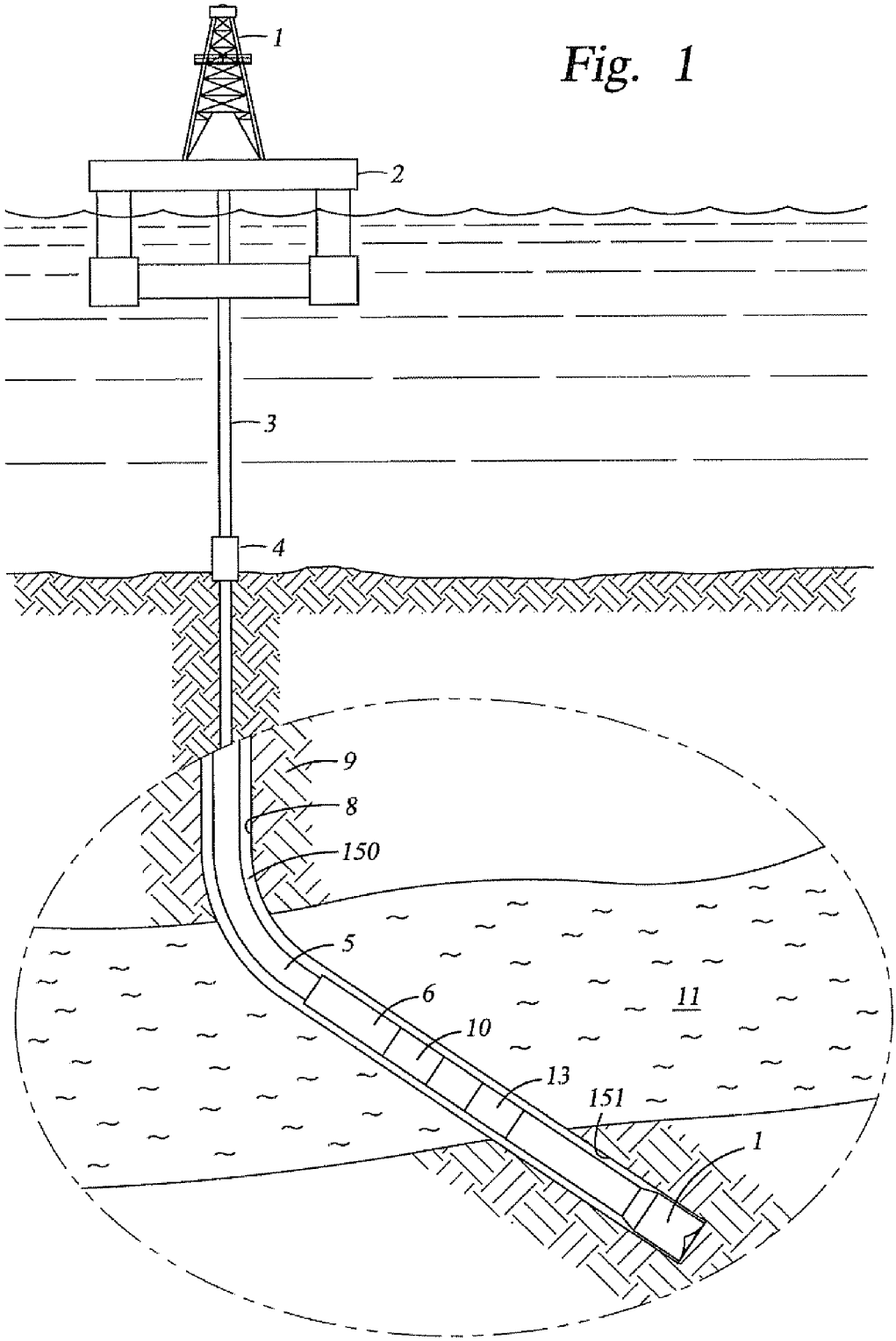
FIG. 1 is a schematic elevation view, partly in cross-section, of an embodiment of the formation tester apparatus disposed in a subterranean well.

Certain terms are used throughout the following description and claims to refer to particular system components. This document does not intend to distinguish between components that differ in name but not function.

In the following discussion and in the claims, the terms "including" and "comprising" are used in an open-ended fashion, and thus should be interpreted to mean "including, but not limited to . . . ". Also, the terms "couple," "couples", and "coupled" used to describe any electrical connections are each intended to mean and refer to either an indirect or a direct electrical connection. Thus, for example, if a first device "couples" or is "coupled" to a second device, that interconnection may be through an electrical conductor directly interconnecting the two devices, or through an indirect electrical connection via other devices, conductors and connections. Further, reference to "up" or "down" are made for purposes of ease of description with "up" meaning towards the surface of the borehole and "down" meaning towards the bottom of the borehole. In addition, in the discussion and claims that follow, it may be sometimes stated that certain components or elements are in fluid communication. By this it is meant that the components are constructed and interrelated such that a fluid could be communicated between them, as via a passageway, tube, or conduit. Also, the designation "MWD" or "LWD" are used to mean all generic measurement while drilling or logging while drilling apparatus and systems.

In the drawings and description that follows, like parts are marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce desired results. The various characteristics mentioned above, as well as other features and characteristics described in more detail below, will be readily apparent to those skilled in the art upon reading the following detailed description of the embodiments, and by referring to the accompanying drawings.

Referring to FIG. 1, an MWD formation tester 10 is illustrated as a part of bottomhole assembly 6 (BHA) that comprises an MWD sub 13 and a drill bit 7 at its lower most end. The BHA 6 is lowered from a drilling platform 2, such as a ship or other conventional platform, via a drill string 5. The drill string 5 is disposed through a riser 3 and a well head 4. Conventional drilling equipment (not shown) is supported within the derrick 1 and rotates the drill string 5 and the drill bit 7, causing the bit 7 to form a borehole 8 through the formation material 9. The borehole 8 penetrates subterranean zones or reservoirs, such as a reservoir 11. It should be understood that the formation tester 10 may be employed in other bottomhole assemblies and with other drilling apparatus in land-based drilling, as well as offshore drilling as shown in FIG. 1. In all instances, in addition to formation tester 10, the bottomhole assembly 6 may contain various conventional apparatus and systems, such as a downhole drill motor, mud pulse telemetry system, measurement-while-drilling sensors and systems, and others well known in the art.

It should also be understood that, even though the MWD formation tester 10 is shown as part of a drill string 5, the embodiments of the invention described below may be conveyed down the borehole 8 via wireline technology, as is partially described above. It should also be understood that the exact physical configuration of the formation tester and the probe assembly is not a requirement of the present invention. The embodiment described below serves to provide an example only. Additional examples of a probe assembly and methods of use are described in U.S. patent application Ser. Nos. 10/440,593, filed May 19, 2003 and entitled "Method and Apparatus for MWD Formation Testing"; U.S. Ser. No. 10/440,835, filed May 19, 2003 and entitled "MWD Formation Tester"; and U.S. Ser. No. 10/440/637, filed May 19, 2003 and entitled "Equalizer Valve"; each hereby incorporated herein by reference for all purposes.

The formation tester tool 10 is best understood with reference to FIGS. 2A–2E. Formation tester 10 generally comprises a heavy walled housing 12 made of multiple sections of drill collar 12*a*, 12*b*, 12*c*, and 12*d* which threadingly engage one another so as to form the complete housing 12. Bottomhole assembly 6 includes flow bore 14 formed through its entire length to allow passage of drilling fluids from the surface through the drill string 5 and through the bit 7. The drilling fluid passes through nozzles in the drill bit face and flows upwards through borehole 8 along the annulus 150 formed between housing 12 and borehole wall 151.

Figure 2A:
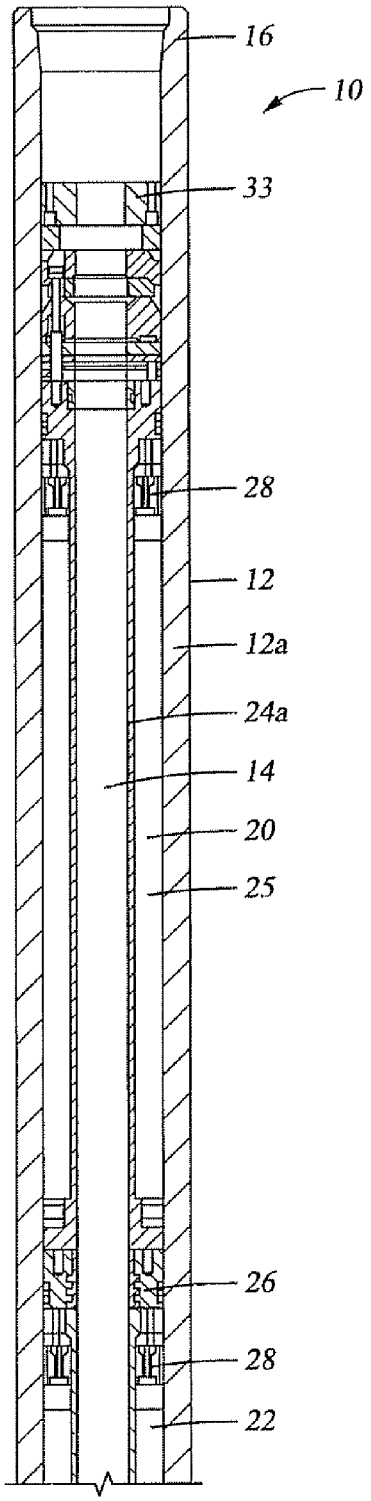
FIGS. 2A–2E are schematic elevation views, partly in cross-section, of portions of the bottomhole assembly and formation tester assembly shown in FIG. 1.
Figure 2B:
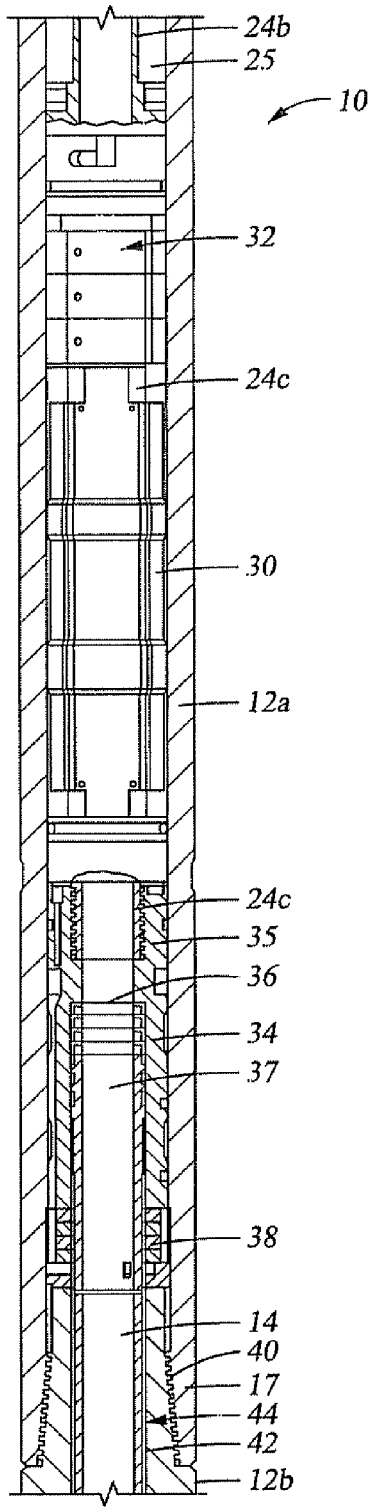

Referring to FIGS. 2A and 2B, upper section 12*a* of housing 12 includes upper end 16 and lower end 17. Upper end 16 includes a threaded box for connecting formation tester 10 to drill string 5. Lower end 17 includes a threaded box for receiving a correspondingly threaded pin end of housing section 12*b*. Disposed between ends 16 and 17 in housing section 12*a* are three aligned and connected sleeves or tubular inserts 24*a,b,c* which creates an annulus 25 between sleeves 24*a,b,c* and the inner surface of housing section 12*a*. Annulus 25 is sealed from flowbore 14 and provided for housing a plurality of electrical components, including battery packs 20, 22. Battery packs 20, 22 are mechanically interconnected at connector 26. Electrical connectors 28 are provided to interconnect battery packs 20, 22 to a common power bus (not shown). Beneath battery packs 20, 22 and also disposed about sleeve insert 24*c* in annulus 25 is electronics module 30. Electronics module 30 includes the various circuit boards, capacitors banks and other electrical components, including the capacitors shown at 32. A connector 33 is provided adjacent upper end 16 in housing section 12*a* to electrically couple the electrical components in formation tester tool 10 with other components of bottomhole assembly 6 that are above housing 12.

Beneath electronics module 30 in housing section 12*a* is an adapter insert 34. Adapter 34 connects to sleeve insert 24*c* at connection 35 and retains a plurality of spacer rings 36 in a central bore 37 that forms a portion of flowbore 14. Lower end 17 of housing section 12*a* connects to housing section 12*b* at threaded connection 40. Spacers 38 are disposed between the lower end of adapter 34 and the pin end of housing section 12*b*. Because threaded connections such as connection 40, at various times, need to be cut and repaired, the length of sections 12*a*, 12*b* may vary in length. Employing spacers 36, 38 allow for adjustments to be made in the length of threaded connection 40.

Housing section 12*b* includes an inner sleeve 44 disposed therethrough. Sleeve 44 extends into housing section 12*a* above, and into housing section 12*c* below. The upper end of sleeve 44 abuts spacers 36 disposed in adapter 34 in housing section 12*a*. An annular area 42 is formed between sleeve 44 and the wall of housing 12*b* and forms a wire way for electrical conductors that extend above and below housing section 12*b*, including conductors controlling the operation of formation tester 10 as described below.

Figure 2C:
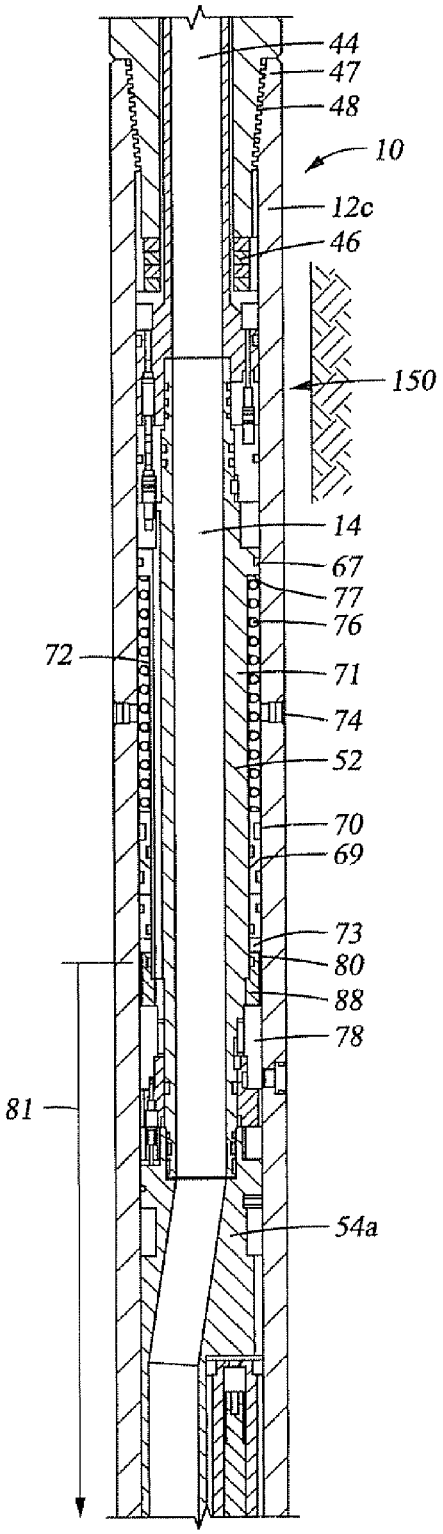
Figure 5:
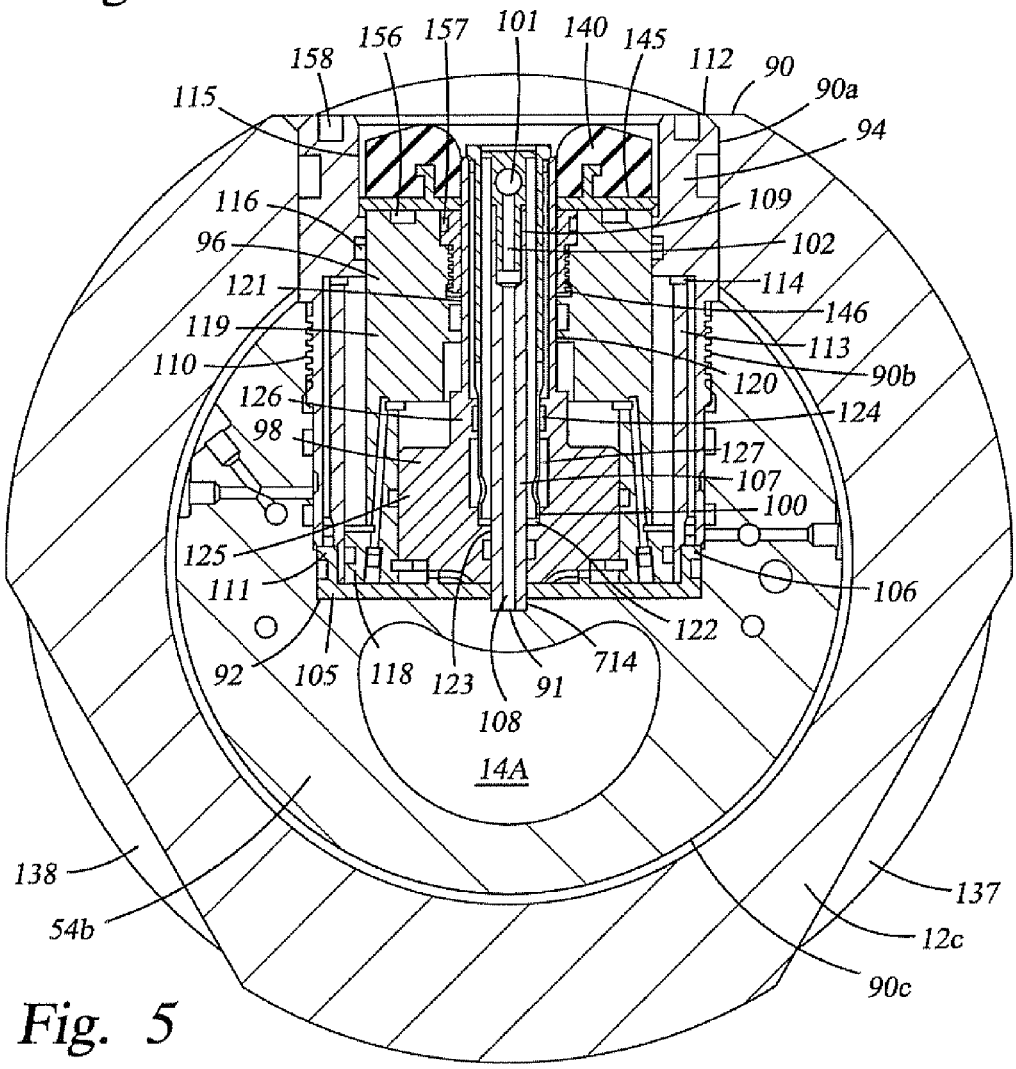
FIG. 5 is a cross-sectional view of the formation probe assembly taken along line 5—5 shown in FIG. 4.

Referring now to FIGS. 2B and 2C, housing section 12*c* includes upper box end 47 and lower box end 48 that threadingly engage housing section 12*b* and housing section 12*c*, respectively. For the reasons previously explained, adjusting spacers 46 are provided in housing section 12*c* adjacent to end 47. As previously described, insert sleeve 44 extends into housing section 12*c* where it stabs into inner mandrel 52. The lower end of inner mandrel 52 stabs into the upper end of formation tester mandrel 54, which is comprised of three axially aligned and connected sections 54*a, b*, and *c*. Extending through mandrel 54 is a deviated flowbore portion 14*a*. Deviating flowbore 14 into flowbore path 14*a* provides sufficient space within housing section 12*c* for the formation tool components described in more detail below. As best shown in FIG. 2E, deviated flowbore 14*a* eventually centralizes near the lower end 48 of housing section 12*c*, shown generally at location 56. Referring momentarily to FIG. 5, the cross-sectional profile of deviated flowbore 14*a* may be a non-circular in segment 14*b*, so as to provide as much room as possible for the formation probe assembly 50.

Figure 2D:
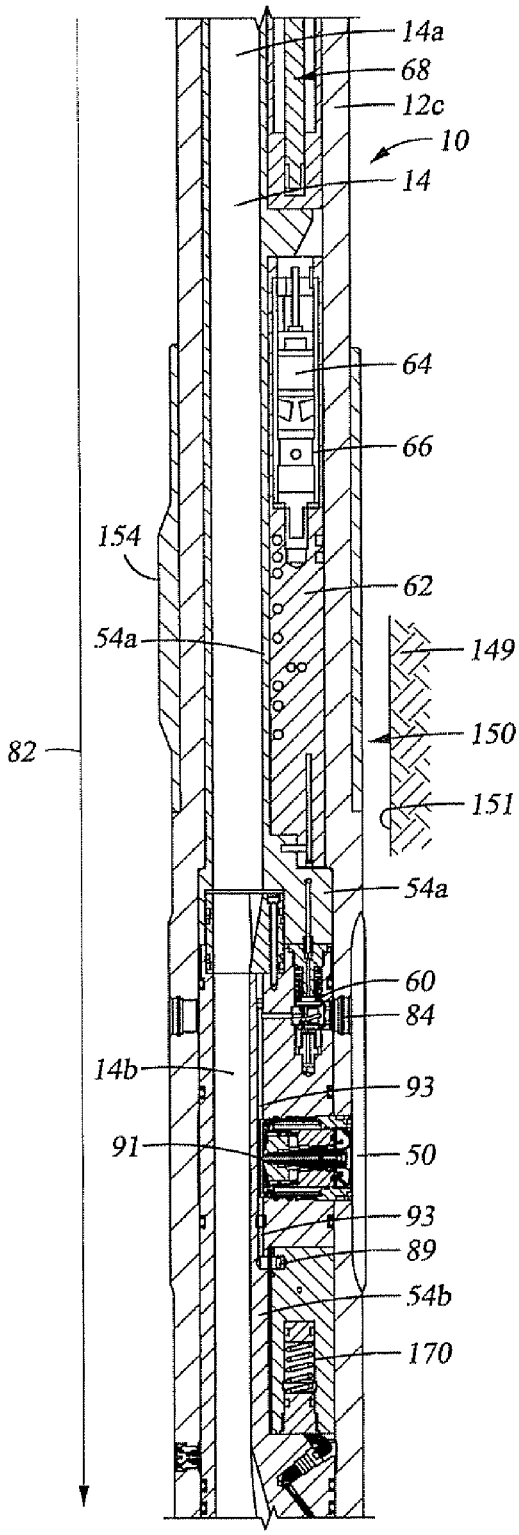
Figure 2E:
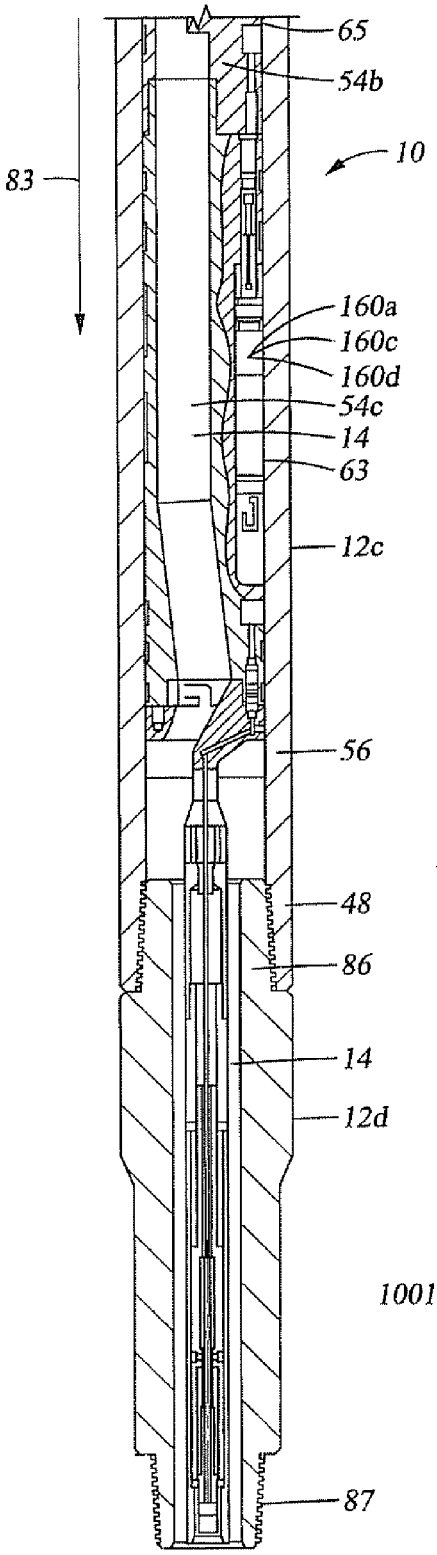

As best shown in FIGS. 2D and 2E, disposed about formation tester mandrel 54 and within housing section 12*c* are electric motor 64, hydraulic pump 66, hydraulic manifold 62, equalizer valve 60, formation probe assembly 50, pressure transducers 160, and drawdown piston 170. Hydraulic accumulators provided as part of the hydraulic system for operating formation probe assembly 50 are also disposed about mandrel 54 in various locations, one such accumulator 68 being shown in FIG. 2D.

Electric motor 64 may be a permanent magnet motor powered by battery packs 20, 22 and capacitor banks 32. Motor 64 is interconnected to and drives hydraulic pump 66. Pump 66 provides fluid pressure for actuating formation probe assembly 50. Hydraulic manifold 62 includes various solenoid valves, check valves, filters, pressure relief valves, thermal relief valves, pressure transducer 160*b* and hydraulic circuitry employed in actuating and controlling formation probe assembly 50 as explained in more detail below.

Referring again to FIG. 2C, mandrel 52 includes a central segment 71. Disposed about segment 71 of mandrel 52 are pressure balance piston 70 and spring 76. Mandrel 52 includes a spring stop extension 77 at the upper end of segment 71. Stop ring 88 is threaded to mandrel 52 and includes a piston stop shoulder 80 for engaging corresponding annular shoulder 73 formed on pressure balance piston 70. Pressure balance piston 70 further includes a sliding annular seal or barrier 69. Barrier 69 consists of a plurality of inner and outer o-ring and lip seals axially disposed along the length of piston 70.

Beneath piston 70 and extending below inner mandrel 52 is a lower oil chamber or reservoir 78, described more fully below. An upper chamber 72 is formed in the annulus between central portion 71 of mandrel 52 and the wall of housing section 12*c*, and between spring stop portion 77 and pressure balance piston 70. Spring 76 is retained within chamber 72. Chamber 72 is open through port 74 to annulus 150. As such, drilling fluids will fill chamber 72 in operation. An annular seal 67 is disposed about spring stop portion 77 to prevent drilling fluid from migrating above chamber 72.

Barrier 69 maintains a seal between the drilling fluid in chamber 72 and the hydraulic oil that fills and is contained in oil reservoir 78 beneath piston 70. Lower chamber 78 extends from barrier 69 to seal 65 located at a point generally noted as 83 and just above transducers 160 in FIG. 2E. The oil in reservoir 78 completely fills all space between housing section 12*c* and formation tester mandrel 54. The hydraulic oil in chamber 78 may be maintained at slightly greater pressure than the hydrostatic pressure of the drilling fluid in annulus 150. The annulus pressure is applied to piston 70 via drilling fluid entering chamber 72 through port 74. Because lower oil chamber 78 is a closed system, the annulus pressure that is applied via piston 70 is applied to the entire chamber 78. Additionally, spring 76 provides a slightly greater pressure to the closed oil system 78 such that the pressure in oil chamber 78 is substantially equal to the annulus fluid pressure plus the pressure added by the spring force. This slightly greater oil pressure is desirable so as to maintain positive pressure on all the seals in oil chamber 78. Having these two pressures generally balanced (even though the oil pressure is slightly higher) is easier to maintain than if there was a large pressure differential between the hydraulic oil and the drilling fluid. Between barrier 69 in piston 70 and point 83, the hydraulic oil fills all the space between the outside diameter of mandrels 52, 54 and the inside diameter of housing section 12*c*, this region being marked as distance 82 between points 81 and 83. The oil in reservoir 78 is employed in the hydraulic circuit 200 (FIG. 10) used to operate and control formation probe assembly 50 as described in more detailed below.

Figure 3:
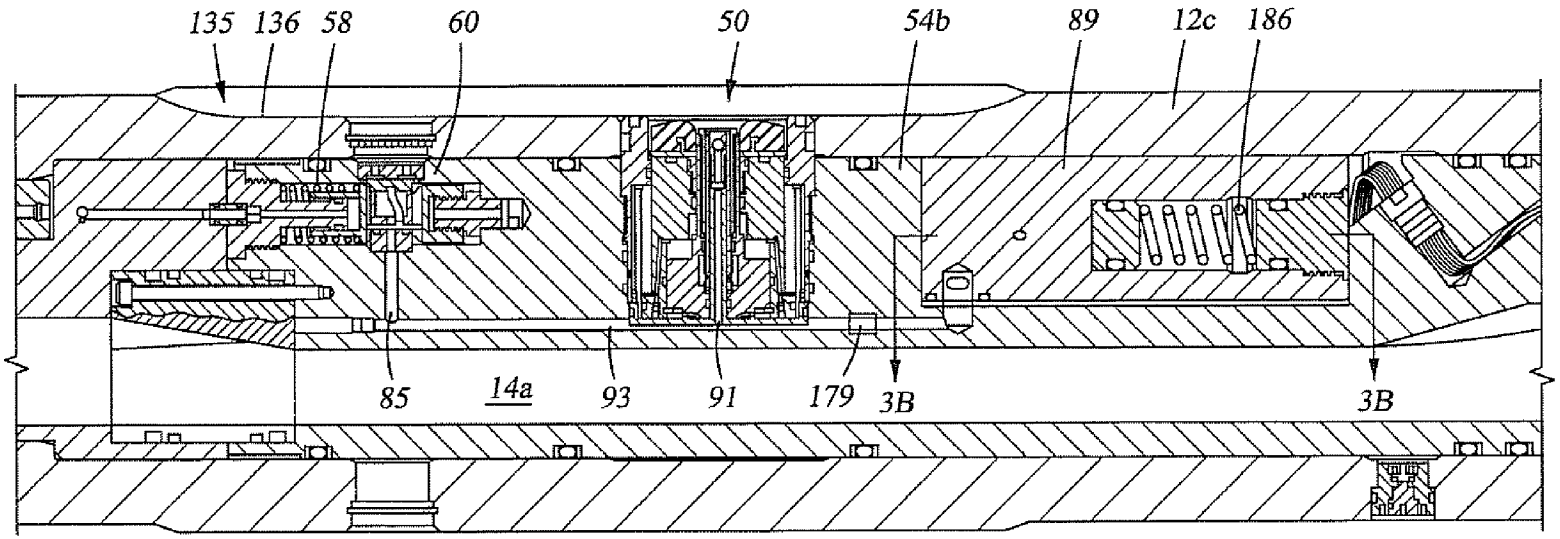
FIG. 3 is an enlarged elevation view, partly in cross-section, of the formation tester tool portion of the formation tester assembly shown in FIG. 2D.

Equalizer valve 60, best shown in FIG. 3, is disposed in formation tester mandrel 54*b* between hydraulic manifold 62 and formation probe assembly 50. Equalizer valve 60 is in fluid communication with hydraulic passageway 85 and with longitudinal fluid passageway 93 formed in mandrel 54*b*. Prior to actuating formation probe assembly 50 so as to test the formation, drilling fluid fills passageways 85 and 93 as valve 60 is normally open and communicates with annulus 150 through port 84 in the wall of housing section 12*c*. When the formation fluids are being sampled by formation probe assembly 50, valve 60 closes the passageway 85 to prevent drilling fluids from annulus 150 entering passageway 85 or passageway 93. A valve particularly well suited for use in this application is the valve described in U.S. patent application Ser. No. 10/440/637, filed May 19, 2003 and entitled "Equalizer Valve", hereby incorporated herein by reference for all purposes.

Figure 4:
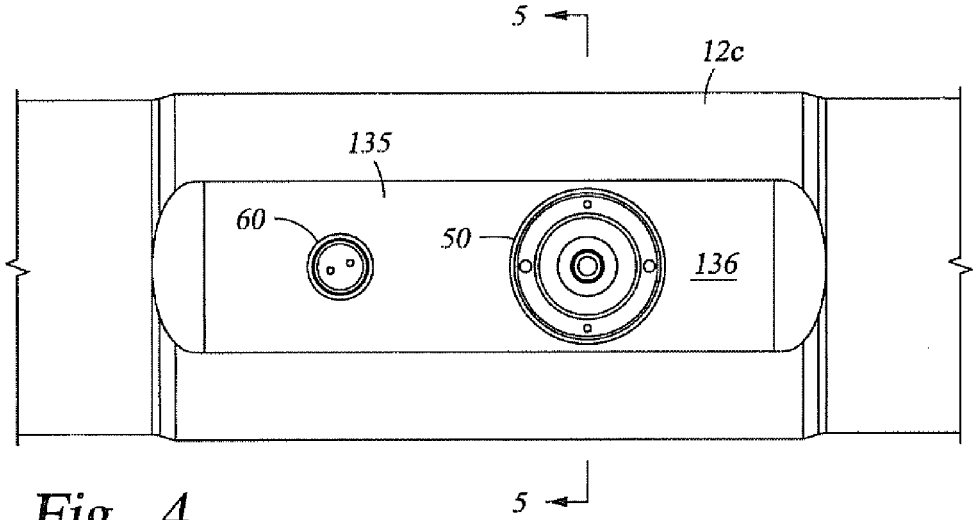
FIG. 4 is an elevation view of the formation tester tool shown in FIG. 3.

As shown in FIGS. 3 and 4, housing section 12*c* includes a recessed portion 135 adjacent to formation probe assembly 50 and equalizer valve 60. The recessed portion 135 includes a planar surface or "flat" 136. The ports through which fluids may pass into equalizing valve 60 and probe assembly 50 extend through flat 136. In this manner, as drill string 5 and formation tester 10 are rotated in the borehole, formation probe assembly 50 and equalizer valve 60 are better protected from impact, abrasion and other forces. Flat 136 is recessed at least ¼ inch and may be at least ½ inch from the outer diameter of housing section 12*c*. Similar flats 137, 138 are also formed about housing section 12*c* at generally the same axial position as flat 136 to increase flow area for drilling fluid in the annulus 150 of borehole 8.

Disposed about housing section 12*c* adjacent to formation probe assembly 50 is stabilizer 154. Stabilizer 154 may have an outer diameter close to that of nominal borehole size. As explained below, formation probe assembly 50 includes a seal pad 140 that is extendable to a position outside of housing 12*c* to engage the borehole wall 151. As explained, probe assembly 50 and seal pad 140 of formation probe assembly 50 are recessed from the outer diameter of housing section 12*c*, but they are otherwise exposed to the environment of annulus 150 where they could be impacted by the borehole wall 151 during drilling or during insertion or retrieval of bottomhole assembly 6. Accordingly, being positioned adjacent to formation probe assembly 50, stabilizer 154 provides additional protection to the seal pad 140 during insertion, retrieval and operation of bottomhole assembly 6. It also provides protection to pad 140 during operation of formation tester 10. In operation, a piston extends seal pad 140 to a position where it engages the borehole wall 151. The force of the pad 140 against the borehole wall 151 would tend to move the formation tester 10 in the borehole, and such movement could cause pad 140 to become damaged. However, as formation tester 10 moves sideways within the borehole as the piston is extended into engagement with the borehole wall 151, stabilizer 154 engages the borehole wall and provides a reactive force to counter the force applied to the piston by the formation. In this manner, further movement of the formation test tool 10 is resisted.

Referring to FIG. 2E, mandrel 54*c* contains chamber 63 for housing pressure transducers 160*a, c*, and *d* as well as electronics for driving and reading these pressure transducers. In addition, the electronics in chamber 63 contain memory, a microprocessor, and power conversion circuitry for properly utilizing power from power bus 700.

Referring still to FIG. 2E, housing section 12*d* includes pins ends 86, 87. Lower end 48 of housing section 12*c* threadingly engages upper end 86 of housing section 12*d*. Beneath housing section 12*d* and between formation tester tool 10 and drill bit 7 are other sections of the bottomhole assembly 6 that constitute conventional MWD tools, generally shown in FIG. 1 as MWD sub 13. In a general sense, housing section 12*d* is an adapter used to transition from the lower end of formation tester tool 10 to the remainder of the bottomhole assembly 6. The lower end 87 of housing section 12*d* threadingly engages other sub assemblies included in bottomhole assembly 6 beneath formation tester tool 10. As shown, flowbore 14 extends through housing section 12*d* to such lower subassemblies and ultimately to drill bit 7.

Figure 3A:
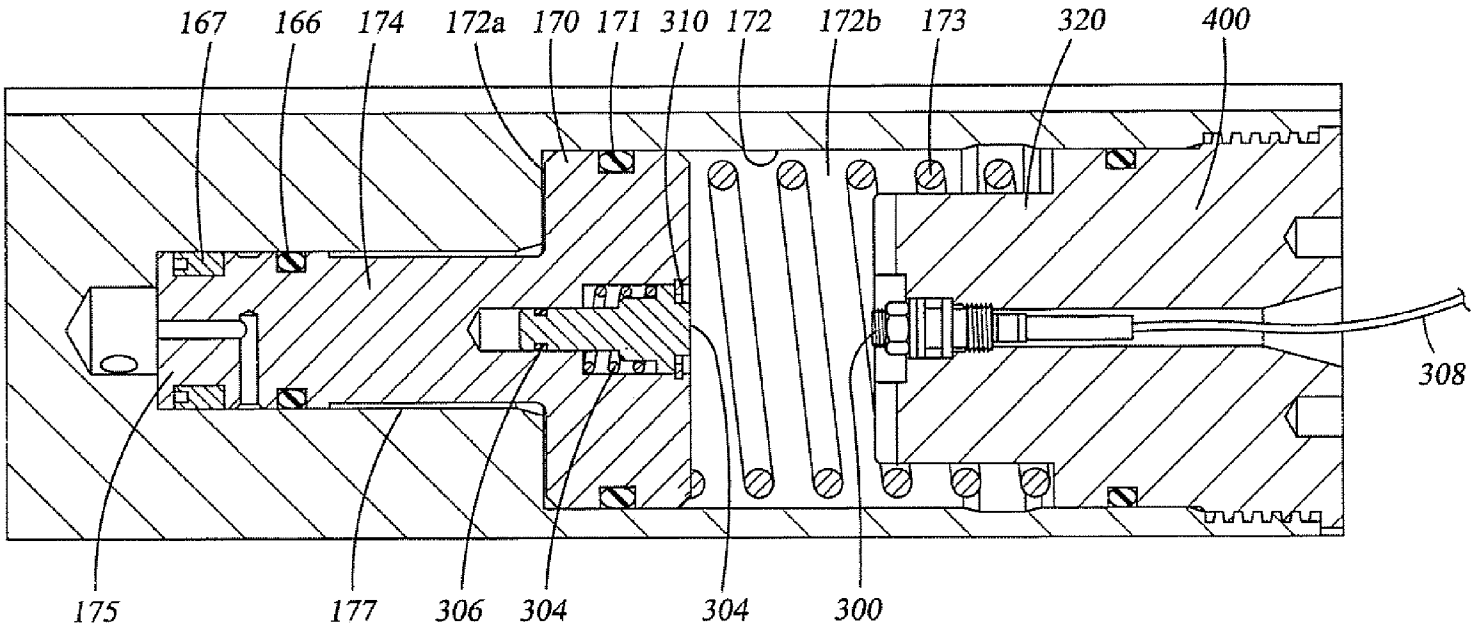
FIG. 3A is an enlarged cross-section view of the drawdown piston and chamber shown in FIG. 3.
Figure 3B:
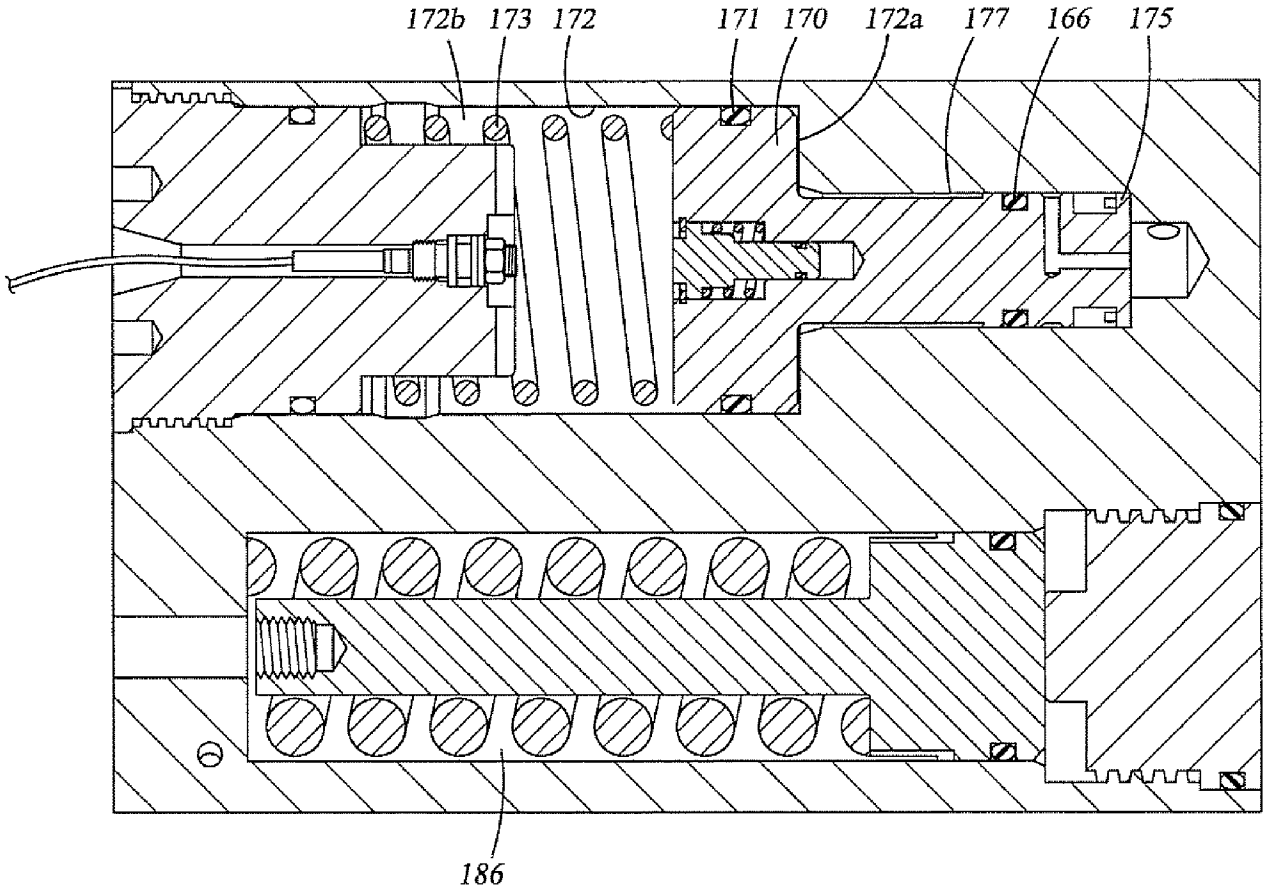
FIG. 3B is an enlarged cross-section view along line 3B—3B of FIG. 3.

Referring again to FIG. 3 and to FIG. 3A, drawdown piston 170 is retained in drawdown manifold 89 that is mounted on formation tester mandrel 54*b* within housing 12*c*. Piston 170 includes annular seal 171 and is slidingly received in cylinder 172. Spring 173 biases piston 170 to its uppermost or shouldered position as shown in FIG. 3A. Separate hydraulic lines (not shown) interconnect with cylinder 172 above and below piston 170 in portions 172*a*, 172*b* to move piston 170 either up or down within cylinder 172 as described more fully below. A plunger 174 is integral with and extends from piston 170. Plunger 174 is slidingly disposed in cylinder 177 coaxial with 172. Cylinder 175 is the upper portion of cylinder 177 that is in fluid communication with the longitudinal passageway 93 as shown in FIG. 3A. Cylinder 175 is flooded with drilling fluid via its interconnection with passageway 93. Cylinder 177 is filled with hydraulic fluid beneath seal 166 via its interconnection with hydraulic circuit 200. Plunger 174 also contains scraper 167 that protects seal 166 from debris in the drilling fluid. Scraper 167 may be an o-ring energized lip seal.

As best shown in FIG. 5, formation probe assembly 50 generally includes stem 92, a generally cylindrical adapter sleeve 94, piston 96 adapted to reciprocate within adapter sleeve 94, and a snorkel assembly 98 adapted for reciprocal movement within piston 96. Housing section 12*c* and formation tester mandrel 54*b* include aligned apertures 90*a*, 90*b*, respectively, that together form aperture 90 for receiving formation probe assembly 50.

Stem 92 includes a circular base portion 105 with an outer flange 106. Extending from base 105 is a tubular extension 107 having central passageway 108. The end of extension 107 includes internal threads at 109. Central passageway 108 is in fluid connection with fluid passageway 91 that, in turn, is in fluid communication with longitudinal fluid chamber or passageway 93, best shown in FIG. 3.

Adapter sleeve 94 includes inner end 111 that engages flange 106 of stem number 92. Adapter sleeve 94 is secured within aperture 90 by threaded engagement with mandrel 54*b* at segment 110. The outer end 112 of adapter sleeve 94 extends to be substantially flushed with flat 136 formed in housing member 12*c*. Circumferentially spaced about the outermost surface of adapter sleeve 94 is a plurality of tool engaging recesses 158. These recesses are employed to thread adapter 94 into and out of engagement with mandrel 54*b*. Adapter sleeve 94 includes cylindrical inner surface 113 having reduced diameter portions 114, 115. A seal 116 is disposed in surface 114. Piston 96 is slidingly retained within adapter sleeve 94 and generally includes base section 118 and an extending portion 119 that includes inner cylindrical surface 120. Piston 96 further includes central bore 121.

Snorkel 98 includes a base portion 125, a snorkel extension 126, and a central passageway 127 extending through base 125 and extension 126.

Formation tester apparatus 50 is assembled such that piston base 118 is permitted to reciprocate along surface 113 of adapter sleeve 94. Similarly, snorkel base 125 is disposed within piston 96 and snorkel extension 126 is adapted for reciprocal movement along piston surface 120. Central passageway 127 of snorkel 98 is axially aligned with tubular extension 107 of stem 92 and with screen 100.

Figure 6C:
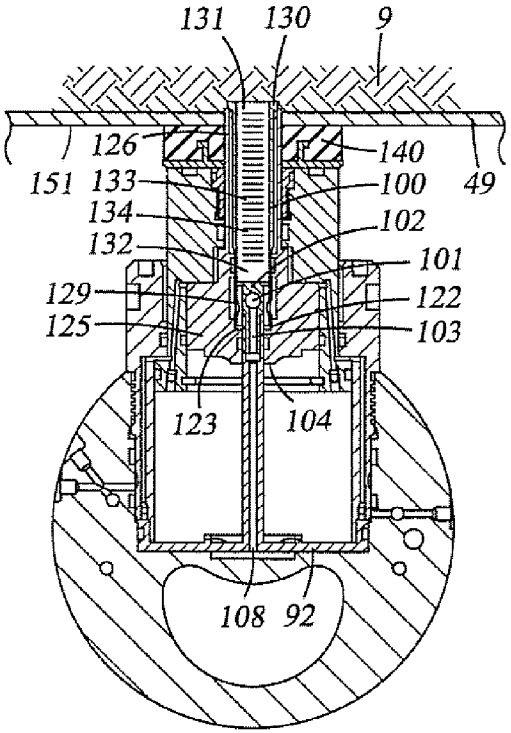
FIGS. 6A–6C are cross-sectional views of a portion of the formation probe assembly taken along the same line as seen in FIG. 5, the probe assembly being shown in a different position in each of FIGS. 6A–6C.

Referring to FIGS. 5 and 6C, screen 100 is a generally tubular member having a central bore 132 extending between a fluid inlet end 131 and outlet end 122. Outlet end 122 includes a central aperture 123 that is disposed about stem extension 107. Screen 100 further includes a flange 130 adjacent to fluid inlet end 131 and an internally slotted segment 133 having slots 134. Apertures 129 are formed in screen 100 adjacent end 122. Between slotted segment 133 and apertures 129, screen 100 includes threaded segment 124 for threadingly engaging snorkel extension 126.

Scraper 102 includes a central bore 103, threaded extension 104 and apertures 101 that are in fluid communication with central bore 103. Section 104 threadingly engages internally threaded section 109 of stem extension 107, and is disposed within central bore 132 of screen 100.

Referring now to FIGS. 5–9, the seal pad 140 may be generally donut-shaped having base surface 141, an opposite sealing surface 142 for sealing against the borehole wall, a circumferential edge surface 143 and a central aperture 144. In the embodiment shown, base surface 141 is generally flat and is bonded to a metal skirt 145. Seal pad 140 seals and prevents drilling fluid from entering the probe assembly 50 during formation testing so as to enable pressure transducers 160 to measure the pressure of the formation fluid. Changes in formation fluid pressure over time provide an indication of the permeability of the formation 9. More specifically, seal pad 140 seals against the mudcake 49 that forms on the borehole wall 151. Typically, the pressure of the formation fluid is less than the pressure of the drilling fluids that are injected into the borehole. A layer of residue from the drilling fluid forms a mudcake 49 on the borehole wall and separates the two pressure areas. Pad 140, when extended, conforms its shape to the borehole wall and, together with the mudcake 49, forms a seal through which formation fluids can be collected.

As best shown in FIGS. 3, 5, and 6, pad 140 is sized so that it can be retracted completely within aperture 90. In this position, pad 140 is protected both by flat 136 that surrounds aperture 90 and by recess 135 that positions face 136 in a setback position with respect to the outside surface of housing 12.

Pad 140 may be made of an elastomeric material having a high elongation characteristic. At the same time, the material may possess relatively hard and wear resistant characteristics. More particularly, the material may have an elongation % equal to at least 200% and even more than 300%. One such material useful in this application is Hydrogenated Nitrile Butadiene Rubber (HNBR). A material found particularly useful for pad 140 is HNBR compound number 372 supplied by Eutsler Technical Products of Houston, Tex. having a durometer hardness of 85 Shore A and a percent elongation of 370% at room temperature.

Figure 7:
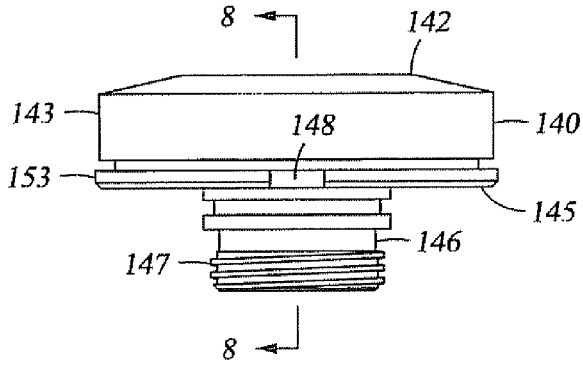
FIG. 7 is an elevation view of the probe pad mounted on the skirt as a preferred embodiment employed in the formation probe assembly shown in FIGS. 4 and 5.
Figure 8:
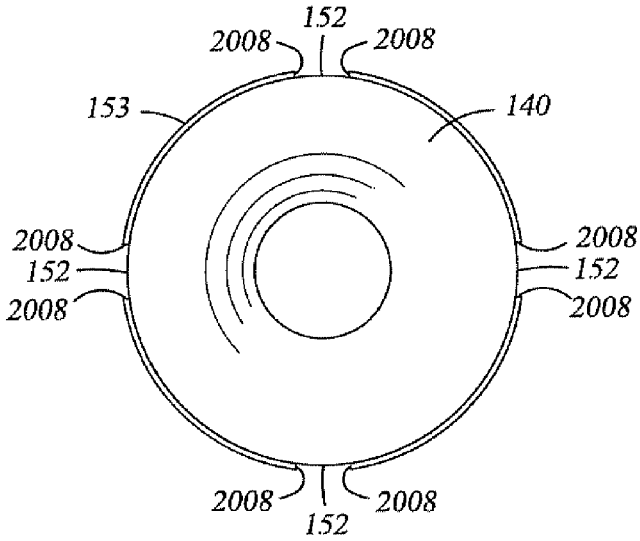
FIG. 8 is a top view of the probe pad shown in FIG. 7.
Figure 9:
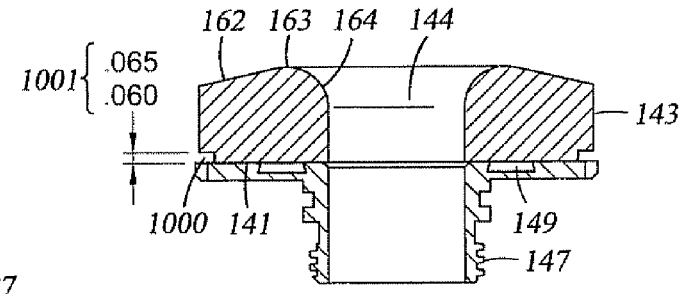
FIG. 9 is a cross-sectional view of the probe pad and skirt taken along line A—A in FIG. 7.

One possible profile for pad 140 is shown in FIGS. 7–9. Sealing surface 142 of pad 140 generally includes a spherical surface 162 and radius surface 164. Spherical surface 162 begins at edge 143 and extends to point 163 where spherical surface 162 merges into and thus becomes a part of radius surface 164. Radius surface 164 curves into central aperture 144 which passes through the center of the pad 140. In the embodiment shown in FIGS. 7–9, pad 140 includes an overall diameter of 2.25 inches with the diameter of central aperture 144 being equal to 0.75 inches. Radius surface 164 has a radius of 0.25 inches, and spherical surface 162 has a spherical radius equal to 4.25 inches. The height of the profile of pad 140 is 0.53 inches at its thickest point.

Referring again to FIGS. 7–9, when pad 140 is compressed, it may extrude into the recesses 152 in skirt 145. The corners 2008 of the recesses 152 can damage the pad, resulting in premature failure. An undercut feature 1000 shown in FIGS. 7 and 9 is cut into the pad to give space between the elastomeric pad 140 and the recesses 152.

As best shown in FIGS. 7 and 9, skirt 145 includes an extension 146 for threadingly engaging extending portion 119 of piston 96 (FIG. 5) at threaded segment 147 (FIGS. 7 and 9). Skirt 145 may also include dovetail groove 149*a* as shown in FIG. 9. When molded, the elastomer fills the dovetail groove. The groove acts to retain the elastomer in the event of de-bonding between the metal skirt 145 and the pad 140. When molded, the elastomer fills the counterbores. As shown in FIG. 5, snorkel extension 126 supports the central aperture 144 of pad 140 (FIG. 7) to reduce the extrusion of the elastomer when it is pressed against the borehole wall during a formation test. Reducing extrusion of the elastomer helps to ensure a good pad seal, especially against the high differential pressure seen across the pad during a formation test.

To help with a good pad seal, tool 10 may include, among other things, centralizers for centralizing the formation probe assembly 50 and thereby normalizing pad 140 relative to the borehole wall. For example, the formation tester may include centralizing pistons coupled to a hydraulic fluid circuit configured to extend the pistons in such a way as to protect the probe assembly and pad, and also to provide a good pad seal. A formation tester including such devices is described in U.S. patent application Ser. No. 10/440,593, filed May 19, 2003 and entitled "Method and Apparatus for MWD Formation Testing", hereby incorporated herein by reference for all purposes.

Figure 10:
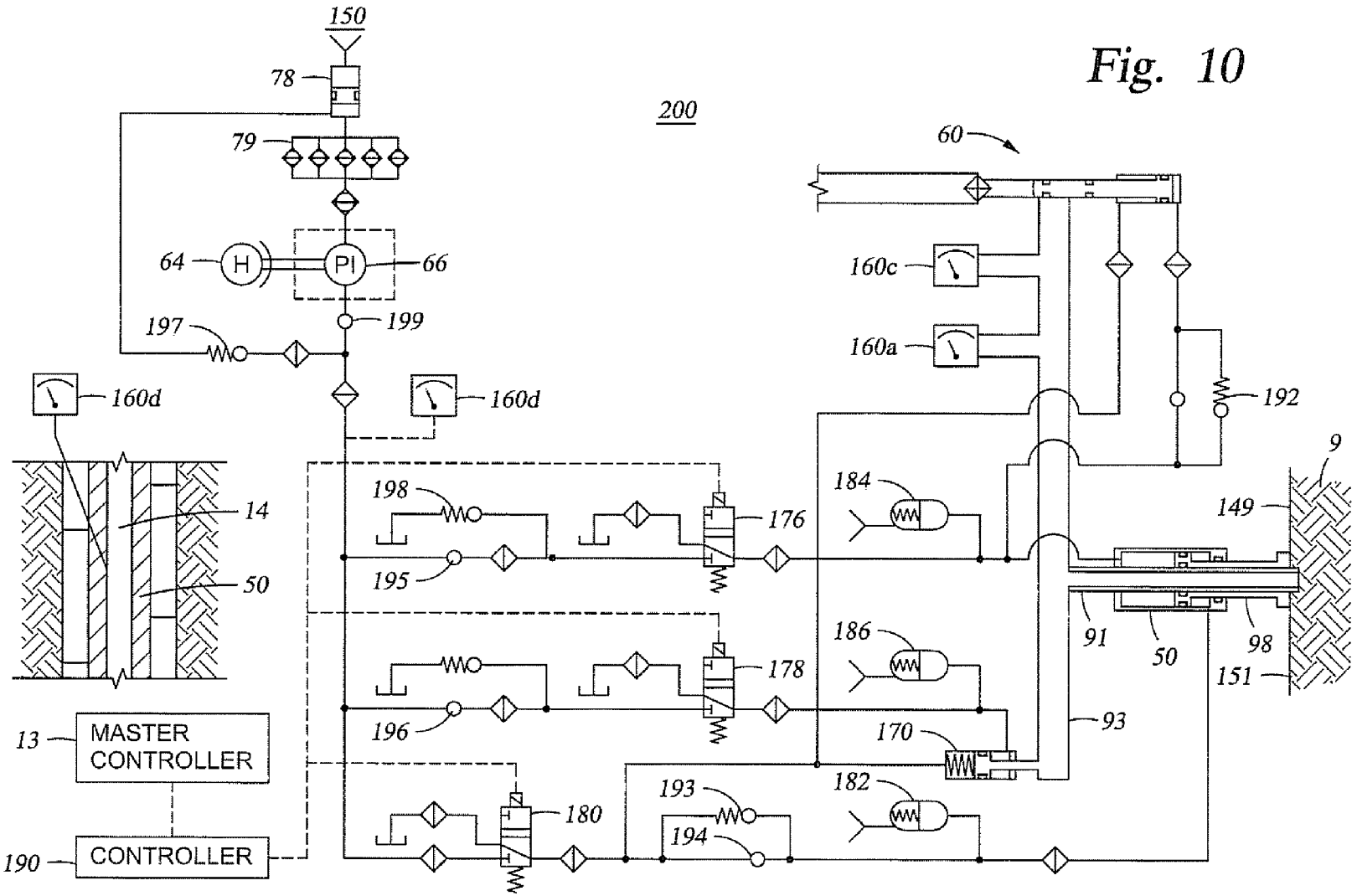
FIG. 10 is a schematic view of a hydraulic circuit employed in actuating the formation tester apparatus.

The hydraulic circuit 200 used to operate probe assembly 50, equalizer valve 60, and drawdown piston 170 is illustrated in FIG. 10. A microprocessor-based controller 190 is electrically coupled to all of the controlled elements in the hydraulic circuit 200 illustrated in FIG. 10, although the electrical connections to such elements are conventional and are not illustrated other than schematically. Controller 190 is located in electronics module 30 in housing section 12*a*, although it could be housed elsewhere in bottomhole assembly 6. Controller 190 detects the control signals transmitted from a master controller (not shown) housed in the MWD sub 13 of the bottomhole assembly 6 which, in turn, receives instructions transmitted from the surface via mud pulse telemetry, or any of various other conventional means for transmitting signals to downhole tools.

Controller 190 receives a command to initiate formation testing. This command may be received when the drill string is rotating or sliding or otherwise moving; however the drill string must be stationary during a formation test. As shown in FIG. 10, motor 64 is coupled to pump 66 that draws hydraulic fluid out of hydraulic reservoir 78 through a serviceable filter 79. As will be understood, the pump 66 directs hydraulic fluid into hydraulic circuit 200 that includes formation probe assembly 50, equalizer valve 60, drawdown piston 170 and solenoid valves 176, 178, 180.

The operation of formation tester 10 is best understood in reference to FIG. 10 in conjunction with FIGS. 3A, 5 and 6A–C. In response to an electrical control signal, controller 190 energizes solenoid valve 180 and starts motor 64. Pump 66 then begins to pressurize hydraulic circuit 200 and, more particularly, charges probe retract accumulator 182. The act of charging accumulator 182 also ensures that the probe assembly 50 is retracted and that drawdown piston 170 is in its initial shouldered position as shown in FIG. 3A. When the pressure in system 200 reaches a predetermined value, such as 1800 psi as sensed by pressure transducer 160*b*, controller 190 (which continuously monitors pressure in the system) energizes solenoid valve 176 and de-energizes solenoid valve 180, which causes probe piston 96 and snorkel 98 to begin to extend toward the borehole wall 151. Concurrently, check valve 194 and relief valve 193 seal the probe retract accumulator 182 at a pressure charge of between approximately 500 to 1250 psi.

Figure 6B:
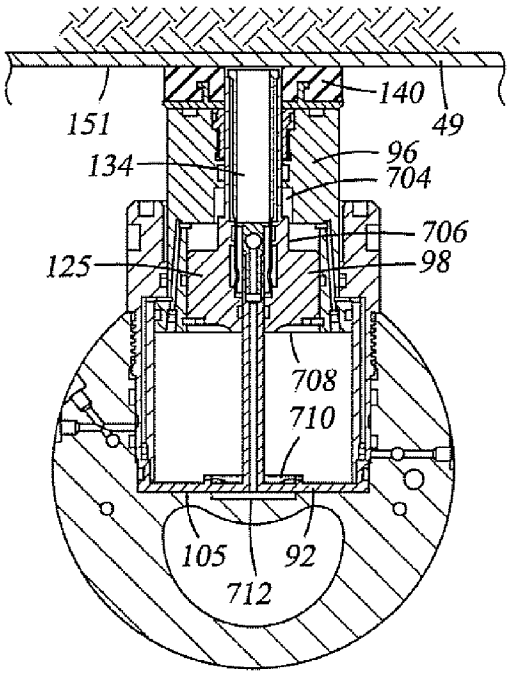
Figure 6A:
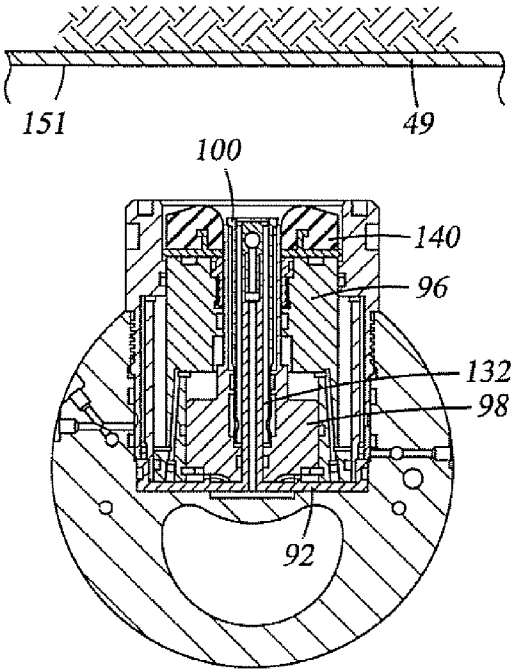

Piston 96 and snorkel 98 extend from the position shown in FIG. 6A to that shown in FIG. 6B where pad 140 engages the mudcake 49 on borehole wall 151. With hydraulic pressure continued to be supplied to the extend side of the piston 96 and snorkel 98, the snorkel then penetrates the mudcake as shown in FIG. 6C. There are two expanded positions of snorkel 98, generally shown in FIGS. 6B and 6C. The piston 96 and snorkel 98 move outwardly together until the pad 140 engages the borehole wall 151. This combined motion continues until the force of the borehole wall against pad 140 reaches a pre-determined magnitude, for example 5,500 lb, causing pad 140 to be squeezed. At this point, a second stage of expansion takes place with snorkel 98 then moving within the cylinder 120 in piston 96 to penetrate the mudcake 49 on the borehole wall 151 and to receive formation fluids.

In one method, as seal pad 140 is pressed against the borehole wall, the pressure in circuit 200 rises and when it reaches a predetermined pressure, valve 192 opens so as to close equalizer valve 60, thereby isolating fluid passageway 93 from the annulus. In this manner, valve 192 ensures that valve 60 closes only after the seal pad 140 has entered contact with mudcake 49 that lines borehole wall 151. In another method, as seal pad 140 is pressed against the borehole wall 151, the pressure in circuit 200 rises and closes equalizer valve 60, thereby isolating fluid passageway 93 from the annulus. In this manner, the valve 60 may close before the seal pad 140 has entered contact with mudcake 49 that lines borehole wall 151. Passageway 93, now closed to the annulus 150, is in fluid communication with cylinder 175 at the upper end of cylinder 177 in drawdown manifold 89, best shown in FIG. 3A.

With solenoid valve 176 still energized, probe seal accumulator 184 is charged until the system reaches a predetermined pressure, for example 1800 psi, as sensed by pressure transducer 160*b*. When that pressure is reached, a delay may occur before controller 190 energizes solenoid valve 178 to begin drawdown. This delay, which is controllable, can be used to measure properties of the mudcake 49 that lines borehole wall 151. Energizing solenoid valve 178 permits pressurized fluid to enter portion 172*a* of cylinder 172 causing drawdown piston 170 to retract. When that occurs, plunger 174 moves within cylinder 177 such that the volume of fluid passageway 93 increases by the volume of the area of the plunger 174 times the length of its stroke along cylinder 177. This movement increases the volume of cylinder 175, thereby increasing the volume of fluid passageway 93. For example, the volume of fluid passageway 93 may be increased by 10 cc as a result of piston 170 being retracted.

As drawdown piston 170 is actuated, formation fluid may thus be drawn through central passageway 127 of snorkel 98 and through screen 100. The movement of drawdown piston 170 within its cylinder 172 lowers the pressure in closed passageway 93 to a pressure below the formation pressure, such that formation fluid is drawn through screen 100 and snorkel 98 into aperture 101, then through stem passageway 108 to passageway 91 that is in fluid communication with passageway 93 and part of the same closed fluid system. In total, fluid chambers 93 (which include the volume of various interconnected fluid passageways, including passageways in probe assembly 50, passageways 85, 93 (FIG. 3), the passageways interconnecting 93 with drawdown piston 170 and pressure transducers 160*a,c*) may have a volume of approximately 40 cc. Drilling mud in annulus 150 is not drawn into snorkel 98 because pad 140 seals against the mudcake. Snorkel 98 serves as a conduit through which the formation fluid may pass and the pressure of the formation fluid may be measured in passageway 93 while pad 140 serves as a seal to prevent annular fluids from entering the snorkel 98 and invalidating the formation pressure measurement.

Referring momentarily to FIGS. 5 and 6C, formation fluid is drawn first into the central bore 132 of screen 100. It then passes through slots 134 in screen slotted segment 133 such that particles in the fluid are filtered from the flow and are not drawn into passageway 93. The formation fluid then passes between the outer surface of screen 100 and the inner surface of snorkel extension 126 where it next passes through apertures 123 in screen 100 and into the central passageway 108 of stem 92 by passing through apertures 101 and central passage bore 103 of scraper 102.

Referring again to FIG. 10, with seal pad 140 sealed against the borehole wall, check valve 195 maintains the desired pressure acting against piston 96 and snorkel 98 to maintain the proper seal of pad 140. Additionally, because probe seal accumulator 184 is fully charged, should tool 10 move during drawdown, additional hydraulic fluid volume may be supplied to piston 96 and snorkel 98 to ensure that pad 140 remains tightly sealed against the borehole wall. In addition, should the borehole wall 151 move in the vicinity of pad 140, the probe seal accumulator 184 will supply additional hydraulic fluid volume to piston 96 and snorkel 98 to ensure that pad 140 remains tightly sealed against the borehole wall 151. Without accumulator 184 in circuit 200, movement of the tool 10 or borehole wall 151, and thus of formation probe assembly 50, could result in a loss of seal at pad 140 and a failure of the formation test.

With the drawdown piston 170 in its fully retracted position and formation fluid drawn into closed system 93, the pressure will stabilize and enable pressure transducers 160*a,c* to sense and measure formation fluid pressure. The measured pressure is transmitted to the controller 190 in the electronic section where the information is stored in memory and, alternatively or additionally, is communicated to the master controller in the MWD tool 13 below formation tester 10 where it can be transmitted to the surface via mud pulse telemetry or by any other conventional telemetry means.

When drawdown is completed, piston 170 actuates a contact switch 320 mounted in endcap 400 and piston 170, as shown in FIG. 3A. The drawdown switch assembly consists of contact 300, wire 308 coupled to contact 300, plunger 302, spring 304, ground spring 306, and retainer ring 310. Piston 170 actuates switch 320 by causing plunger 302 to engage contact 300 that causes wire 308 to couple to system ground via contact 300 to plunger 302 to ground spring 306 to piston 170 to endcap 400 that is in communication with system ground (not shown).

When the contact switch 320 is actuated controller 190 responds by shutting down motor 64 and pump 66 for energy conservation. Check valve 196 traps the hydraulic pressure and maintains piston 170 in its retracted position. In the event of any leakage of hydraulic fluid that might allow piston 170 to begin to move toward its original shouldered position, drawdown accumulator 186 will provide the necessary fluid volume to compensate for any such leakage and thereby maintain sufficient force to retain piston 170 in its retracted position.

During this interval, controller 190 continuously monitors the pressure in fluid passageway 93 via pressure transducers 160*a,c* until the pressure stabilizes, or after a predetermined time interval.

When the measured pressure stabilizes, or after a predetermined time interval, controller 190 de-energizes solenoid valve 176. De-energizing solenoid valve 176 removes pressure from the close side of equalizer valve 60 and from the extend side of probe piston 96. Spring 58 then returns the equalizer valve 60 to its normally open state and probe retract accumulator 182 will cause piston 96 and snorkel 98 to retract, such that seal pad 140 becomes disengaged with the borehole wall. Thereafter, controller 190 again powers motor 64 to drive pump 66 and again energizes solenoid valve 180. This step ensures that piston 96 and snorkel 98 have fully retracted and that the equalizer valve 60 is opened. Given this arrangement, the formation tool 10 has a redundant probe retract mechanism. Active retract force is provided by the pump 66. A passive retract force is supplied by probe retract accumulator 182 that is capable of retracting the probe even in the event that power is lost. Accumulator 182 may be charged at the surface before being employed downhole to provide pressure to retain the piston and snorkel in housing 12*c*.

Referring again briefly to FIGS. 5 and 6, as piston 96 and snorkel 98 are retracted from their position shown in FIG. 6C to that of FIG. 6B, screen 100 is drawn back into snorkel 98. As this occurs, the flange on the outer edge of scraper 102 drags and thereby scrapes the inner surface of screen member 100. In this manner, material screened from the formation fluid upon its entering of screen 100 and snorkel 98 is removed from screen 100 and deposited into the annulus 150. Similarly, scraper 102 scrapes the inner surface of screen member 100 when snorkel 98 and screen 100 are extended toward the borehole wall.

After a predetermined pressure, for example 1800 psi, is sensed by pressure transducer 160*b* and communicated to controller 190 (indicating that the equalizer valve is open and that the piston and snorkel are fully retracted), controller 190 de-energizes solenoid valve 178 to remove pressure from side 172*a* of drawdown piston 170. With solenoid valve 180 remaining energized, positive pressure is applied to side 172*b* of drawdown piston 170 to ensure that piston 170 is returned to its original position (as shown in FIG. 3). Controller 190 monitors the pressure via pressure transducer 160*b* and when a predetermined pressure is reached, controller 190 determines that piston 170 is fully returned and it shuts off motor 64 and pump 66 and de-energizes solenoid valve 180. With all solenoid valves 176, 178, 180 returned to their original position and with motor 64 off, tool 10 is back in its original condition and drilling can again be commenced.

Relief valve 197 protects the hydraulic system 200 from overpressure and pressure transients. Various additional relief valves may be provided. Thermal relief valve 198 protects trapped pressure sections from overpressure. Check valve 199 prevents back flow through the pump 66.

Figure 11:
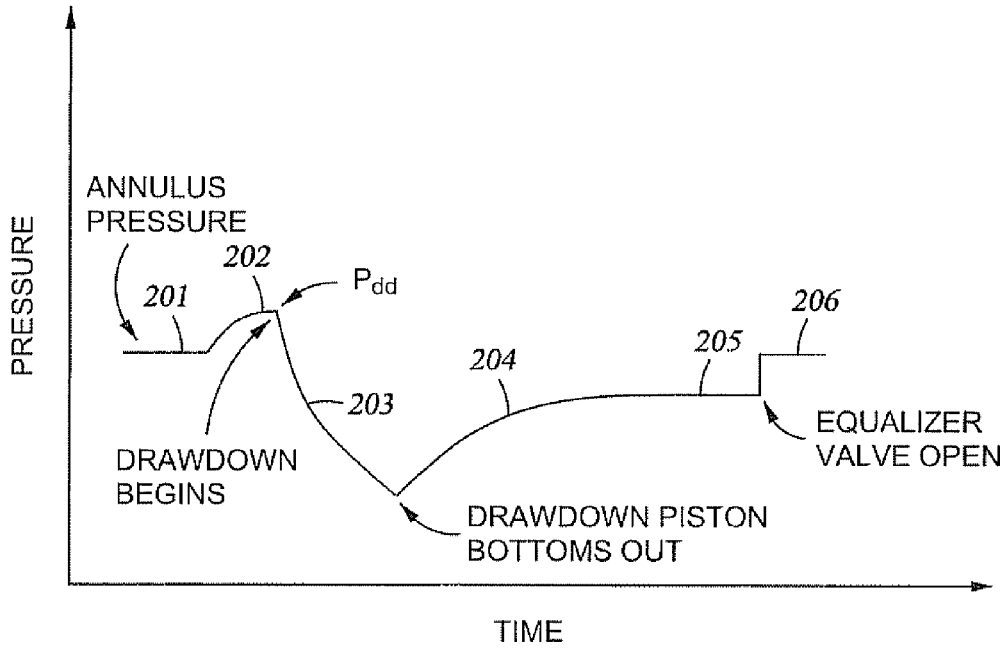
FIG. 11 is a graph of the formation fluid pressure as compared to time measured during operation of the tester apparatus.

FIG. 11 illustrates a pressure versus time graph illustrating in a general way the pressure sensed by pressure transducer 160*a,c* during the operation of formation tester 10. As the formation fluid is drawn within the tester, pressure readings are taken continuously by transducer 160*a,c*. The sensed pressure will initially be equal to the annulus pressure shown at point 201. As pad 140 is extended and equalizer valve 60 is closed, there will be a slight increase in pressure as shown at 202. This occurs when the pad 140 seals against the borehole wall 151 and squeezes the drilling fluid trapped in the now-isolated passageway 93. As drawn down piston 170 is actuated, the volume of the closed chamber 93 increases, causing the pressure to decrease as shown in region 203. This is known as the pretest drawdown. The combination of the flow rate and snorkel ID determines an effective range of operation. When the drawn down piston bottoms out within cylinder 172, a differential pressure with the formation fluid exists causing the fluid in the formation to move towards the low pressure area and, therefore, causing the pressure to build over time as shown in region 204. The pressure begins to stabilize, and at point 205, achieves the pressure of the formation fluid in the zone being tested at the borehole wall. After a fixed time, such as three minutes after the end of region 203, the equalizer valve 60 is again opened, and the pressure within chamber 93 equalizes back to the annulus pressure as shown at 206.

Referring again to FIG. 10, the formation test tool 10 may include four pressure transducers 160: two quartz crystal gauges 160*a*, 160*d*, a strain gauge 160*c*, and a differential strain gage 160*b*. One of the quartz crystal gauges 160*a* is in communication with the annulus mud and also senses formation pressures during the formation test. The other quartz crystal gauge 160*d* is in communication with the flowbore 14 at all times. In addition, both quartz crystal gauges 160*a* and 160*d* may have temperature sensors associated with the crystals. The temperature sensors may be used to compensate the pressure measurement for thermal effects. The temperature sensors may also be used to measure the temperature of the fluids near the pressure transducers. For example, the temperature sensor associated with quartz crystal gauge 160*a* is used to measure the temperature of the fluid near the gage in chamber 93. The third transducer is a strain gauge 160*c* and is in communication with the annulus mud and also senses formation pressures during the formation test. The quartz transducers 160*a,d* provide accurate, steady-state pressure information, whereas the strain gauge 160*c* provides faster transient response. In performing the sequencing during the formation test, chamber 93 is closed off and both the annulus quartz gauge 160*a* and the strain gauge 160*c* measure pressure within the closed chamber 93. The strain gauge transducer 160*c* essentially is used to supplement the quartz gauge 160*a* measurements. When the formation tester 10 is not in use, the quartz transducers 160*a,d* may operatively measure pressure while drilling to serve as a pressure while drilling tool.

Figure 12:
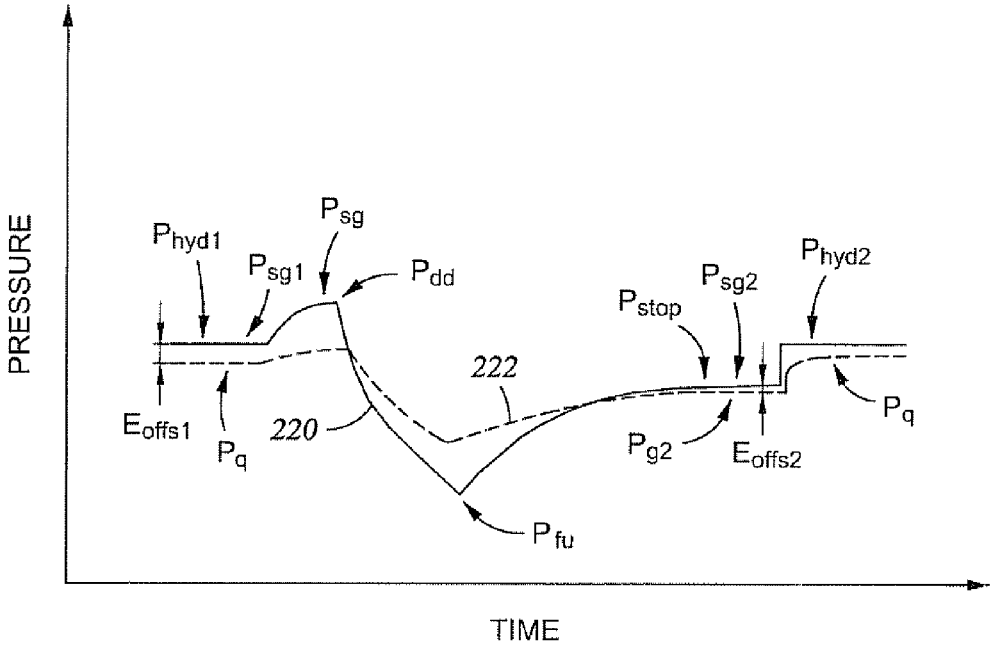
FIG. 12 is another graph of the formation fluid pressure as compared to time measured during operation of the tester apparatus and showing pressures measured by different pressure transducers employed in the formation tester.

FIG. 12 illustrates representative formation test pressure curves. The solid curve 220 represents pressure readings $P_{sg}$ detected and transmitted by the strain gauge 160*c*. Similarly, the pressure $P_q$, indicated by the quartz gauge 160*a*, is shown as a dashed line 222. As noted above, strain gauge transducers generally do not offer the accuracy exhibited by quartz transducers and quartz transducers do not provide the transient response offered by strain gauge transducers. Hence, the instantaneous formation test pressures indicated by the strain gauge 160*c* and quartz 160*a* transducers are likely to be different. For example, at the beginning of a formation test, the pressure readings $P_{hyd1}$ indicated by the quartz transducer $P_q$ and the strain gauge $P_{sg}$ transducer are different and the difference between these values is indicated as $E_{offs1}$ in FIG. 12.

With the assumption that the quartz gauge reading $P_q$ is the more accurate of the two readings, the actual formation test pressures may be calculated by adding or subtracting the appropriate offset error $E_{offs1}$ to the pressures indicated by the strain gauge $P_{sg}$ for the duration of the formation test. In this manner, the accuracy of the quartz transducer and the transient response of the strain gauge may both be used to generate a corrected formation test pressure that, where desired, is used for real-time calculation of formation characteristics.

As the formation test proceeds, it is possible that the strain gauge readings may become more accurate or for the quartz gauge reading to approach actual pressures in the pressure chamber even though that pressure is changing. In either case, it is probable that the difference between the pressures indicated by the strain gauge transducer and the quartz transducer at a given point in time may change over the duration of the formation test. Hence, it may be desirable to consider a second offset error that is determined at the end of the test when steady state conditions have been resumed. Thus, as pressures $P_{hyd2}$ level off at the end of the formation test, it may be desirable to calculate a second offset error $E_{offs2}$. This second offset error $E_{offs2}$ might then be used to provide an after-the-fact adjustment to the formation test pressures.

The offset values $E_{offs1}$ and $E_{offs2}$ may be used to adjust specific data points in the test. For example, all critical points up to $P_{fu}$ might be adjusted using errors $E_{offs1}$, whereas all remaining points might be adjusted offset using error $E_{offs2}$. Another solution may be to calculate a weighted average between the two offset values and apply this single weighted average offset to all strain gauge pressure readings taken during the formation test. Other methods of applying the offset error values to accurately determine actual formation test pressures may be used accordingly and will be understood by those skilled in the art.

The formation test tool 10 may operate in two general modes: pump-on operation and pump-off operation. During pump on operation, mud pumps on the surface pump drilling fluid through the drill string 6 and back up the annulus 150. Using that column of drilling fluid, the tool 10 can transmit data to the surface using mud pulse telemetry during the formation test. The tool 10 may also receive mud pulse telemetry downlink commands from the surface. During a formation test, the drill pipe and formation test tool are not rotated. However, it may be the case that an immediate movement or rotation of the drill string will be necessary. As a failsafe feature, at any time during the formation test, an abort command can be transmitted from surface to the formation test tool 10. In response to this abort command, the formation test tool will immediately discontinue the formation test and retract the probe piston to its normal, retracted position for drilling. The drill pipe can then be moved or rotated without causing damage to the formation test tool.

During pump-off operation, a similar failsafe feature may also be active. The formation test tool 10 and/or MWD tool 13 may be adapted to sense when the mud flow pumps are turned on. Consequently, the act of turning on the pumps and reestablishing flow through the tool may be sensed by pressure transducer 160*d* or by other pressure sensors in bottomhole assembly 6. This signal will be interpreted by a controller in the MWD tool 13 or other control and communicated to controller 190 that is programmed to automatically trigger an abort command in the formation test tool 10. At this point, the formation test tool 10 will immediately discontinue the formation test and retract the probe piston to its normal position for drilling. The drill pipe can then be moved or rotated without causing damage to the formation test tool.

The uplink and downlink commands are not limited to mud pulse telemetry. By way of example and not by way of limitation, other telemetry systems may include manual methods, including pump cycles, flow/pressure bands, pipe rotation, or combinations thereof. Other possibilities include electromagnetic (EM), acoustic, and wireline telemetry methods. An advantage to using alternative telemetry methods lies in the fact that mud pulse telemetry (both uplink and downlink) requires pump-on operation but other telemetry systems do not. The failsafe abort command may therefore be sent from the surface to the formation test tool using an alternative telemetry system regardless of whether the mud flow pumps are on or off.

The downhole receiver for downlink commands or data from the surface may reside within the formation test tool or within an MWD tool 13 with which it communicates. Likewise, the downhole transmitter for uplink commands or data from down hole may reside within the formation test tool 10 or within an MWD tool 13 with which it communicates. The receivers and transmitters may each be positioned in MWD tool 13 and the receiver signals may be processed, analyzed, and sent to a master controller in the MWD tool 13 before being relayed to local controller 190 in formation testing tool 10.

Commands or data sent from surface to the formation test tool can be used for more than transmitting a failsafe abort command. The formation test tool can have many preprogrammed operating modes. A command from the surface may be used to select the desired operating mode. For example, one of a plurality of operating modes may be selected by transmitting a header sequence indicating a change in operating mode followed by a number of pulses that correspond to that operating mode. Other means of selecting an operating mode will be known to those skilled in the art.

In addition to the operating modes discussed, other information may be transmitted from the surface to the formation test tool 10. This information may include critical operational data such as depth or surface drilling mud density. The formation test tool 10 may use this information to help refine measurements or calculations made downhole or to select an operating mode. Commands from the surface might also be used to program the formation test tool 10 to perform in a mode that is not preprogrammed.

An example of an operating mode of the test tool 10 is the ability to adapt the pressure test procedure to take into account any supercharge pressure effect on the formation 9 at different test depths.

Figure 13:
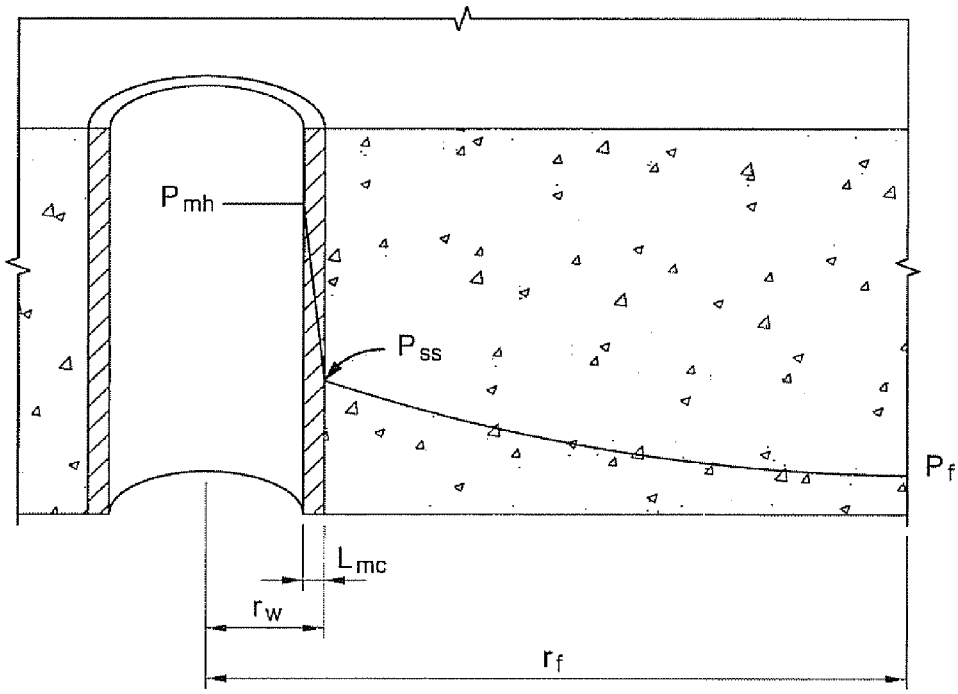
FIG. 13 is a graph of the pressure distribution from borehole hydrostatic, across the mudcake, and extending into the formation.

Mud filtrate invasion and formation of the mudcake 49 primarily influence pressure variations near the borehole wall 151. During drilling, the borehole pressure may be maintained at a pressure substantially greater than the formation pore pressure ($P_f$) to control production of formation fluids into the borehole 8. When a producing zone is penetrated, the borehole wall 151 is exposed to hydrostatic pressure ($P_{mh}$) and filtrate invades the formation 9 near the borehole wall 151. The mudcake 49 then forms by the resultant deposit of solids in the drilling fluid on the borehole wall 151. This process is normally referred to as static filtration. The mudcake 49 grows and eventually stabilizes to a maximum thickness. This is a result of the shearing action of the mud circulation in the annulus 150 as well as mechanical action of any rotating of the drill pipe 5. This process is referred to as dynamic filtration. During these processes, a pressure gradient is established in the formation 9, as illustrated in FIG. 13. The pressure in the borehole 8 near the surface of the mudcake 49 is at hydrostatic pressure ($P_{mh}$) but drops across the mudcake 49 and then continues to reduce in the formation 9, forming a gradient approaching formation pressure ($P_f$) some distance away from the borehole wall 151. The supercharge pressure ($P_{sc}$) is the difference between the pressure at the sandface, or borehole wall 151 ($P_{ss}$), and the formation pressure ($P_f$).

The actual supercharge pressure gradient depends on the characteristics of the drilling fluid, the drilling parameters, and the properties of the formation being tested. Additionally, for pressure tests performed during static filtration, the supercharge pressure ($P_{sc}$) may change as the mudcake 49 is forming over time. Transient pressure effects might also include pulses in the hydrostatic pressure caused by the test tool 10 operating in pumps on mode. There may also be further transient pressure effects due to the movement of the drill string 5 causing a "swabbing" effect such as when drilling fluid is being circulated in the borehole 8.

To determine the supercharge pressure ($P_{sc}$) while taking into account transient pressure effects, the testing tool 10 measures the hydrostatic pressure ($P_{mh}$). The test tool 10 then performs a drawdown and buildup pressure test to determine the pressure at the borehole wall 151 similar to the recordings shown in FIGS. 11 and 12. In this process the pressure recorded by the test tool 10 tends to disturb the borehole wall 151 pressures. This "disturbed" pressure recording is caused by the probe assembly 50 blocking drilling fluid seepage into the formation 9 around the probe seal pad 140. An example of determining the pressure at the borehole wall 151 under "disturbed" conditions is described in U.S. Pat. No. 5,644,076 issued Jul. 1, 1997 and entitled "Wireline Formation Tester Supercharge Correction Method", hereby incorporated herein by reference for all purposes. To measure the mudcake properties, a leak-off test can be performed prior to the drawdown-buildup test. In the leak-off test, the pad 140 may be extended to seal against the mudcake 49 without disturbing the mudcake 49. When pressed against the mudcake 49, the volume of fluid trapped inside the probe assembly 50 by the pad 140 experiences higher pressure. The fluid is trapped by the sealing action of the probe against the mudcake and the combined resistance to flow offered by the mudcake 49 and formation 9 near the probe area. Alternatively, this higher pressure may be enhanced by ejecting fluids through the formation probe assembly 50 without increasing the pressure of the formation probe assembly 50 against the mudcake 49, thus avoiding disturbing the mudcake 49. However, additional hydraulic pressure may also be placed on the pad 140 to increase the pressure. The test tool 10 measures the pressure of the fluid trapped by the seal pad 140 over time as the pressure eventually decreases relative to hydrostatic pressure in the borehole 8 due to the flow of high-pressure wellbore fluids through the mudcake 49. The rate of fluid flow outward into the formation 9 is governed primarily by the permeability of the mudcake 49, the thickness of the mudcake 49, mud filtrate fluid viscosity, and the formation permeability. Thus, measuring the rate of pressure decline, or "leak off", during this initial period provides useful data to generate indicia of the properties of the mudcake 49 and the formation 9. Permeability and viscosity may be combined into a variable called mobility that is a ratio of the two properties (i.e., k/μ, mDarcy/cp) and represents the resistance to flow, otherwise viscosity must be assumed or measured by a different method.

The "undisturbed" pressure at the borehole wall 151 under the mudcake 49 is then modeled to determine the pressure at the borehole wall 151 undisturbed by the probe assembly 50. An example of modeling the undisturbed pressure at the borehole wall 151 is described in U.S. Provisional Patent Application Ser. No. 60/549,092 filed Mar. 1, 2004 and entitled "Formation Testing While Drilling Tool", hereby incorporated herein by reference for all purposes. Another example of modeling the undisturbed pressure at the borehole wall 151 is also described in U.S. Pat. No. 5,644,076 issued Jul. 1, 1997 and entitled "Wireline Formation Tester Supercharge Correction Method", hereby incorporated herein by reference for all purposes.

After the leak-off test, the test tool 10 then performs at least one drawdown and/or build-up test as described above to obtain pressure measurements of the formation 9. The sudden pressure change during the drawdown penetrates the mudcake so that the tool 10 can be in hydraulic communication with the formation. Now formation properties can be determined from the buildup pressures, including formation permeability or mobility, and fluid compressibility. Using these formation properties along with the mudcake properties derived from the leak-off test, the supercharge pressure of the formation 9 can be determined using a formation model that uses the dynamic properties of the mudcake 49, such as the growth of the mudcake 49. An example of a supercharge pressure model using the dynamic properties of the mudcake 49 can be derived from a single phase supercharge model that assumes single phase Darcy flow. With the single phase supercharge model, the supercharge pressure ($P_{sc}$) can be predicted using the radial flow equations for an infinite homogeneous reservoir.

$$\Delta P_{sc} = P_{ss} - P_f = \left[\frac{q_m \mu}{4\pi h k_f}\right] \ln\left[\frac{4k_f t}{\gamma \phi \mu c r_w^2}\right] \tag{1}$$

where $\Delta P_{sc}$ is the change due to supercharge pressure, $P_{ss}$ is the sandface supercharge pressure, $P_f$ is the formation pressure, $q_m$ is the mud filtrate flow rate (cc/sec), $\mu$ is the viscosity (cp), h is the reservoir unit length (ft), $k_f$ is the formation spherical permeability (md), t is the invasion time or the time from which the formation was drilled and mudcake started to grow (sec), $\gamma$ is Euler's constant (1.78), $\phi$ is formation porosity, c is total compressibility (1/psi), and $r_w$ is the wellbore radius (cm).

Assuming the mudcake is relatively thin compared to the wellbore diameter (i.e., $l_{mc} \ll r_w$ where $l_{mc}$ is mudcake maximum thickness (cm)), the flow through the mudcake can be modeled as a linear Darcy flow with the pressure differential between the borehole mud hydrostatic ($P_{mh}$) and the sandface supercharge pressure ($P_{ss}$) creating the mud filtrate loss ($q_m$).

$$q_m = \frac{2\pi r_w h k_{mc}}{\mu l_{mc}} (P_{mh} - P_{ss}) \tag{2}$$

where $k_{mc}$ is the mudcake permeability (md) and $P_{mh}$ is the hydrostatic pressure.

Figure 14:
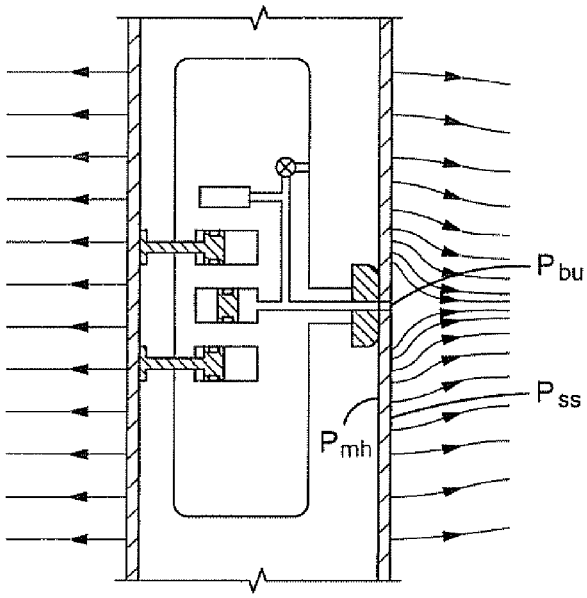
FIG. 14 is a graph of the sandface buildup pressure and the undisturbed sandface pressure.

As described above, to determine the supercharge pressure an equation may be used to estimate the "undisturbed" sandface pressure under the mudcake (see FIG. 14). The pad element creates a disturbance in the near-wellbore. This is caused by the pad element completely blocking the mud seepage around the probe. This disturbance is related to the velocity of the filtrate in the near wellbore region:

$$v_m = \frac{q_m}{2\pi r_w h} = \frac{k_f}{\lambda_e r_e \mu} (P_{ss} - P_{bu}) \tag{3}$$

where $\lambda_e$ packer element shape factor, $r_e$ is the pad element radius (cm), and $P_{bu}$ is the buildup pressure.

The pad element shape factor $\lambda_e$ is a local geometric correction accounting for non-spherical effects, and can be determined both analytically and numerically. The analytical solution for potential flow around a circular flat disk can be used, which suffices for simple estimates. Alternatively, finite element simulations can be used to determine this shape factor which can consider the well bore curvature.

Now using Equations 1 through 3, an expression for the supercharge pressure can be determined in terms of the hydrostatic pressure ($P_{mh}$) and sandface buildup pressure ($P_{bu}$) as well as the formation and mud properties.

$$\Delta P_{sc} = \frac{P_{mh} - P_{bu}}{2} \left( \frac{\frac{r_w}{l_{mc}} \frac{k_{mc}}{k_f}}{1 + \frac{\lambda_e r_e}{l_{mc}} \frac{k_{mc}}{k_f}} \right) \ln\left(\frac{4k_f t}{\gamma \phi \mu c r_w^2}\right) \tag{4}$$

Using the following non-dimensional parameters, $$p_{Dsc} = \frac{\Delta P_{ss}}{\Delta P_{ob}} = \frac{P_{ss} - P_f}{P_{mh} - P_{bu}} \tag{5}$$

where $p_{Dsc}$ is dimensionless supercharge pressure, $\Delta P_{ss}$ is the supercharge pressure differential, and $\Delta P_{ob}$ is the overbalance pressure differential;

$$t_D = \frac{4k_f t}{\gamma \phi \mu c r_w^2} \tag{6}$$

where $t_D$ is dimensionless time;

$$r_{Dre} = \frac{\lambda_e r_e}{r_w} \tag{7}$$

where $r_{Dre}$ is the pad element dimensionless radius; and $$\tau_{Dmc} = \frac{r_w}{l_{mc}} \frac{k_{mc}}{k_f} \tag{8}$$

where $\tau_{Dmc}$ is the mudcake transmissibility ratio.

Equation 4 can be reduced to a simpler form so that the effect these non-dimensional parameters have can be studied.

$$p_{Dsc}(t) = \frac{1}{2}\left(\frac{\tau_{Dmc}}{1 + \tau_{Dmc} r_{Dre}}\right) \ln(t_D) \tag{9}$$

The dimensionless supercharge pressure $p_{Dsc}$ is the relative degree of supercharging based on measured pressures and normalized to the apparent overbalance. The apparent overbalance $\Delta P_{ob}$ is the difference between hydrostatic drilling fluid pressure and the measured sandface buildup pressure. The term $p_{Dsc}$ is the ratio of the actual supercharge $\Delta P_{sc}$ based on the undisturbed sandface pressure to the apparent overbalance $\Delta P_{ob}$, which can be measured using the formation test tool 10.

Dimensionless time $t_D$ determines the transient response of the supercharging. Its definition is the same as that used for transient well testing.

The pad element dimensionless radius $r_{De}$ determines the relative degree that the measured sandface buildup pressure $P_{bu}$ deviates from the actual sandface or supercharged pressure $P_{ss}$. It is primarily dominated by geometric constraints of the system and not influenced by mudcake or formation properties.

The mudcake transmissibility ratio $\tau_{Dmc}$ determines the overall supercharge effect based on the mudcake and formation properties. It is a measure of the relative resistance to filtrate invasion from the mudcake versus the formation resistance. If the transmissibility ratio is small, the mudcake dominates the filtrate invasion and supercharging is small. If the transmissibility ratio is large, invasion is primarily influenced by the formation and supercharging is relatively high.

The dynamic properties of the mudcake 49 may then be included in the model. For example, a model for predicting mudcake growth may be used that was developed for radial flow.

$$\frac{1}{2}\left(1-\frac{l_{mc}}{r_w}\right)^2\left(\ln\left(1-\frac{l_{mc}}{r_w}\right)-\frac{1}{2}\right)+\frac{1}{4}=\frac{k_{mc}\lambda_{mc}\Delta P_{mc}t}{\mu r_w^2} \tag{10}$$

where $\lambda_{mc}$ is the mudcake compaction factor and $\Delta P_{mc}$ is the mudcake pressure differential. The derivation of Equation 10 assumes that mudcake differential $\Delta P_m$ is constant, but it is not limited to this constraint. As the mudcake 49 forms, the pressure differential may change. In this case, the integral $\int \Delta P_m(t)dt$ would simply appear in place of $\Delta P_m t$. In this general form, Equation 10 can be used as a boundary condition for a multiphase reservoir model where the mudcake growth is coupled to the filtrate invasion.

By assuming the mudcake 49 is small relative to the wellbore radius (i.e., $l_{mc}/r_w \rightarrow 0$), it can be shown that Equation 8 can be reduced to the following simpler expression.

$$l_{mc}(t)=\sqrt{\frac{2k_{mc}\lambda_{mc}\Delta P_{mc}t}{\mu}} \tag{11}$$

This equation is the lineal filtration model where the filter cake grows with the square root of time. The $\sqrt{t}$ approximation is quite satisfactory for values of $l_{mc}/r_w<0.20$. This conclusion applies to radial and linear mudcake buildup but may not apply to cake buildup on formations where the mudcake and formation have comparable permeabilities. Fortunately, the later situation is rarely the case for most producing zones and Equation 12 below is a reasonable short-hand method to estimate mudcake growth.

The linear mudcake model can be incorporated into the general supercharge equation, Equation 9, by applying superposition to the incremental time periods used to predict the mudcake growth.

$$p_{Dsc}(t)=\frac{1}{2}\sum_{i=1}^{n}[(A_i-A_{i-1})\ln(t_D-t_{D(i-1)})] \tag{12}$$

where:

$$A_i=\tau_{Dmc}(t_i) \tag{13}$$

This model couples mudcake growth to the supercharge pressure.

Assuming that formation pressure is known, the following relationship can be developed to predict supercharging.

$$\Delta P_{sc}=\frac{P_f+p_{Dsc}P_{mh}}{1+p_{Dsc}}-P_f \tag{14}$$

Mudcake properties can also be determined from a static filtration press, originally designed by P. H. Jones, and has long been used to characterize static mudcake growth. Since its inception, similar devices have been developed to measure filtration properties at wellbore temperatures and pressures. The mudcake permeability properties, $k_{mc}$, and the compaction factor, $\lambda_{mc}$, that appear in Equations 11 and 12 may be measured from the static filtration press as follows:

$$\lambda_{mc}=\frac{l_{mc}(t)}{h(t)}=\frac{f_s}{(1-f_s)(1-\phi_{mc})} \tag{16}$$

$$\left(\frac{k_{mc}}{\mu}\right)=\frac{l_{mc}(t)}{2t}\frac{h(t)}{\Delta p} \tag{17}$$

The quantities $l_{mc}(t)$ and $h(t)$ are the measured mudcake thickness and filtrate fluid height, respectively, at time t while maintaining a constant differential pressure $\Delta p$ across a filter used to grow the mudcake. The mudcake compaction factor (Equation 15) is a dimensionless parameter that can be related to the porosity $\phi_{mc}$ and the solid fraction $f_s$ of the drilling fluid. This relationship was developed considering the filtration of a fluid suspension of solid particles by a porous but rigid mudcake. While mudcakes may not behave as ideal solutions with solid particles, the compaction factor is a measured property that characterizes the mudcake growth in downhole conditions. Additionally, this test is run routinely to test mudcakes in the drilling process.

Figure 15:
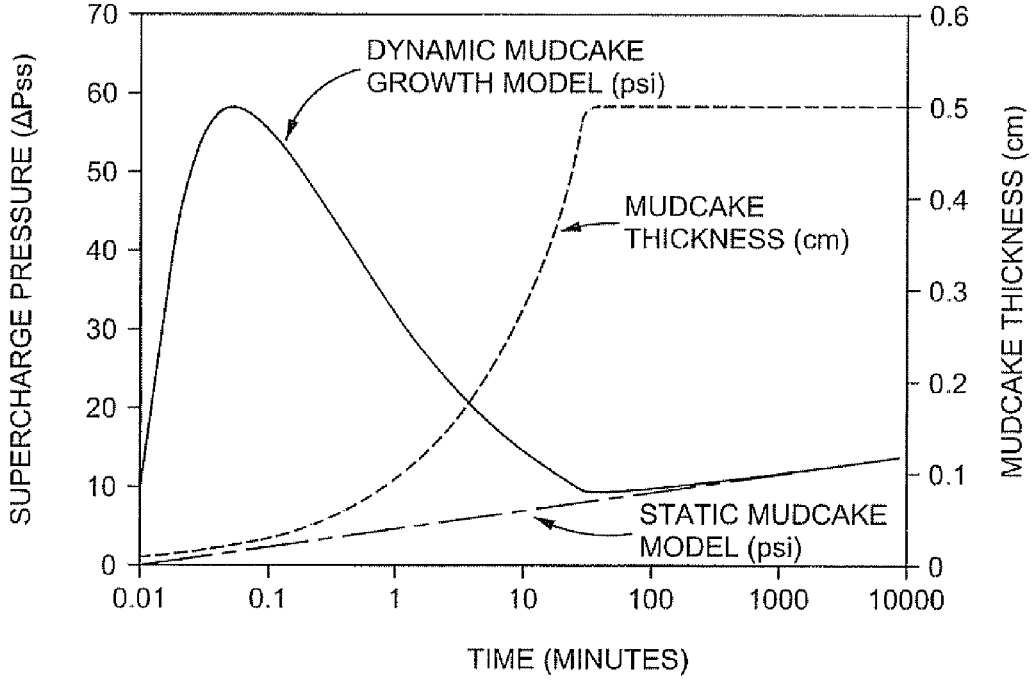
FIG. 15 is a graph that shows the pressure at the borehole wall over time.

An example sensitivity analysis illustrates the supercharge effect with invasion time using the variables shown in TABLE 1. FIG. 15 illustrates the supercharge effect. The supercharge pressure may increase rapidly at the very early time periods and then peaks as the mudcake 49 grows and chokes off the invasion. FIG. 15 illustrates the results for the two supercharge models. The first assumes a mudcake of constant thickness determined by Equation 10. The second uses Equations 11 and 12 to simulate supercharging where the mudcake 49 develops over time. To simulate the mudcake growth for the static and dynamic filtration process, the mudcake is allowed to grow until it reaches its maximum thickness of 0.5 cm. This process may take about 10 minutes and, as shown in FIG. 15, the dimensionless supercharge continues to decline during this time period. After the mudcake 49 stops growing, the supercharge pressure starts to increase and may approach the static thickness model. To determine the degree of supercharging, the dimensionless supercharge pressure is multiplied by the apparent overbalance, which is the difference between hydrostatic mud pressure and the FTWD buildup pressure (i.e., $\Delta P_{ob}=P_{mh}-P_{bu}$).

TABLE 1

Supercharge Example

| Sensitivity variable | Units | Base |
|---|---|---|
| Formation permeability | $k_f$ (md) | 1.0 |
| Formation porosity | $\phi$ | 0.25 |
| Formation filtrate viscosity | $\mu$ (cp) | 1.0 |
| Formation compressibility | c (1/psi) | $3 \times 10^{-6}$ |

TABLE 1-continued

| Supercharge Example | | |
|---|---|---|
| Sensitivity variable | Units | Base |
| Mudcake permeability | $k_{mc}$ (md) | .0001 |
| Mudcake porosity | $\phi_{mc}$ | 0.01 |
| Mud solid fraction | $f_s$ | 0.9 |
| Mudcake compaction factor | $\lambda_{mc}$ | 10.0 |
| Mudcake maximum thickness | $l_{mc}$ (cm) | 0.5 |
| Overbalance Pressure | $\Delta P_{ob}$ (psi) | 1000 |
| Wellbore radius | $r_w$ (cm) | 10.0 |
| Packer element radius | $r_e$ (cm) | 5.0 |
| Packer element shape factor | e | 1.1 |
| Unit reservoir height | h (cm) | 1 |

Figure 16:
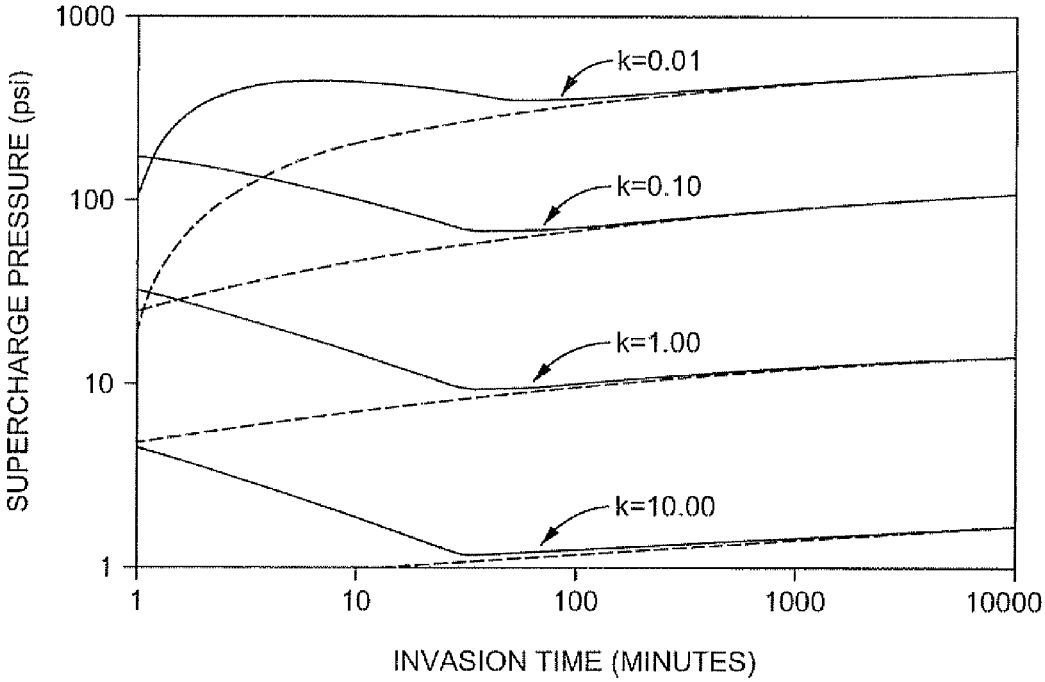
FIG. 16 is a graph of supercharge sensitivity in relation to formation permeability.

FIG. 16 illustrates additional simulations where the reservoir permeability is varied from 0.1 md to 10 md. FIG. 16 illustrates that supercharging may vary geometrically with formation permeability. The same is true for mudcake permeability because these parameters are combined together in the mudcake transmissibility dimensionless constant$_{Dmc}$. These cases reflect field experience where supercharging becomes a significant factor in zones with less than 1 md.

Alternatively, the supercharge model may also take into account pressure transients caused by the pumps operating as well as the "swabbing" of the test tool 10. Pumps on operation is common in FTWD testing so that data can be transmitted to the surface in real time. Further, pumps-on operation helps prevent pipe "sticking". However, having the pumps on may produce pressure pulses in the borehole as high as 100 psi at a 1 Hz frequency.

Additional hydrostatic variations may be produced due to the swabbing action of the drill string 5. When depth changes are made the friction of the pipe can create a pressure dynamic. The pipe movement may create hydrostatic pressure changes of as much as 50 psi over the duration of a pressure test.

To single out and observe the pressure fluctuations caused by pumps on operation and swabbing, a constant mudcake thickness model may be used. The overbalance is also assumed to vary sinusoidally. To simulate swabbing, the overbalance is increased linearly. Using a similar development used for the supercharging model, it can be shown that the sandface pressures are modeled using a modified form of Equation 12, but in this case the mudcake 49 is constant and A varies as follows.

$$A_i = \left(\frac{\tau_{Dmc}}{1 + r_{Dre}\tau_{Dmc}}\right)\sin(2\pi f t_i) + \frac{G t_i}{\Delta P_{ob}} \tag{18}$$

where G is the pressure time gradient (psi/sec).

Figure 17:
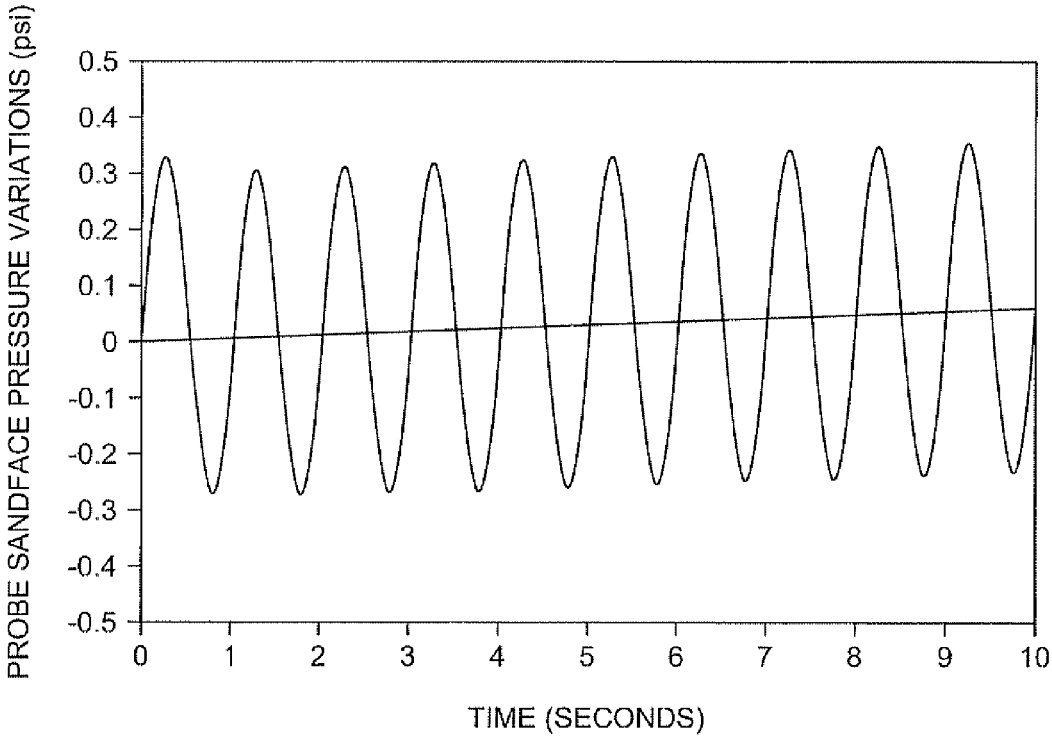
FIG. 17 shows probe pressure variations related to hydrostatic pressure.

Using a mud pulse frequency of 1 Hz for f and a linear gradient of 5 psi/min for G, FIG. 17 shows the results for the probe pressure fluctuations over a 10 second time period. This simulation includes the same input variables as the supercharge example presented previously (TABLE 1). Pressures may vary as much as ±0.3 psi due to pressure pulses, and there is a gradual increase in pressure of about 0.1 psi over 10 seconds. Because quartz gauges average data between updates, the mud pulses are sufficiently small that they may not be observed. Also, depending on the length of time that swabbing continues, these pressure changes could be muted as well. The magnitude of these pressure changes depends on the mudcake transmissibility ratio, much like the supercharging. Therefore, if the permeability of the formation increases above 1 md, these borehole dynamic effects may be isolated from the FTWD testing.

It should be appreciated that other analytical and numerical supercharge models may be used. For example, while the preceding supercharge model assumes single phase flow, in many cases the mud filtrate is different from the formation fluids. To accurately account for these differences a multiphase model can be used. In some cases the mud filtrate can be miscible or immiscible with the formation fluids. This requires a more complex model that usually requires numerical methods. Regardless of the model used the following procedures for predicting supercharge applies WFT and FTWD tools. Examples of additional supercharge models are disclosed in the article entitled "Formation Testing In the Dynamic Drilling Environment" by M. Proett, D. Seifert, W. Chin, and P. Sands presented at the SPWLA 45$^{th}$ Annual Logging Symposium, Jun. 6–9, 2004 as well as the article titled "Multiple Factors that Influence Wireline Formation Tester Pressure Measurements and Fluid Contact Estimates" by M. Proett, W. Chin, M. Manohar, R. Sigal, and J. Wu, SPE 71566, presented at the 2001 SPE Annual Technical Conference and Exhibition held in New Orleans, La., 30 Sep.–3 Oct. 2001, both articles hereby incorporated herein by reference for all purposes.

Using the supercharge models described previously, supercharging can be predicted using several methods. First, supercharge pressures can be predicted by estimating the formation, mudcake and fluid properties. Formation properties typically include permeability and porosity. Mudcake properties include permeability, maximum thickness and compaction factor which are used to predict mudcake growth rate. These properties can be determined in a mudcake filtration test. Fluid properties consist of compressibility and viscosity. Generally these properties are estimated prior to drilling a well and an estimate of supercharging can be made using the single phase model that accounts for mudcake growth. These estimates assume single phase invasion. Additionally more complex models can be used to account for multiphase models but additional information needs to be estimated, such as relative permeability of the two phases and capillary pressure. For these complex cases a numerical model is used.

The second method of estimating the supercharge pressure is to use the pressure recordings of the tester tool 10. All formation tester pressure data can be used to estimate the formation permeability in addition to measuring the hydrostatic and borehole or sandface pressure behind the mudcake 49. Then, using this information and the mud cake properties from surface mudcake filtration tests an estimate of supercharging can be made using Equations 1 and 9 or 12 and 13. Again multiphase models can also be employed.

The third method of estimating the supercharge pressure is to measure the mudcake properties in situ. This is inherently more accurate since the mudcake thickness and permeability can vary through out the well. For calculating the supercharge pressure, the test tool 10 also measures properties of the mudcake 49 and the formation 9. An example of a method of measuring the mudcake 49 properties is described in U.S. Pat. No. 5,644,076 issued Jul. 1, 1997 and entitled "Wireline Formation Tester Supercharge Correction Method", hereby incorporated herein by reference for all purposes. To measure the mudcake properties, the pad 140 may be extended to seal against the mudcake 49 without disturbing the mudcake 49. When pressed against the mudcake 49, the volume of fluid trapped inside the probe assembly 50 by the pad 140 experiences higher pressure.

Alternatively, this higher pressure may be enhanced by ejecting fluids through the formation probe assembly 50 without increasing the pressure of the formation probe assembly 50 against the mudcake 49, thus avoiding disturbing the mudcake 49. However, additional hydraulic pressure may also be placed on the pad 140 to increase the pressure. The test tool 10 measures the pressure of the fluid trapped by the seal pad 140 over time as the pressure eventually decreases relative to hydrostatic pressure in the borehole 8 due to the flow of high-pressure wellbore fluids through the mudcake 49. The rate of fluid flow outward into the formation 9 is governed by the permeability of the mudcake 49. Thus, measuring the rate of pressure decline, or "leak off", during this initial period provides useful data to generate indicia of the properties of the mudcake 49 and the formation 9. Using the mudcake property data from the formation test tool 10, the supercharge pressure on the formation 9 can then be calculated using a mathematical model described in U.S. Pat. No. 5,644,076 issued Jul. 1, 1997 and entitled "Wireline Formation Tester Supercharge Correction Method", hereby incorporated herein by reference for all purposes. The mathematical model includes calculations that take into account transient pressure effects on the pressure measurements made by the test tool 10. However, the supercharge model describe in U.S. Pat. No. 5,644,076 assumes that invasion is not dynamic but can be assumed to be static when the tester measurement are made. Using Equations 1, 9, 12, and 13 does not make this assumption so that the supercharge pressure is more accurately estimated.

The fourth method uses the fact that invasion is dynamic and therefore supercharging can cause the pressures to change over time. For example if a pressure test is taken while drilling into the well with a FTWD tool and then recorded again several days later as the bottom hole assembly is being pulled the pressure can change. As shown in FIG. 15 borehole pressures decline when the mudcake is building and then start to increase one the mudcake thickness is established. By adjusting the supercharge model's mudcake properties the measured pressures from two or more pressure test can be matched to a curve similar to FIG. 15. This can be done using Equation 12 or a numerical simulation.

The fifth method also used the changing pressures over time to characterize supercharging. In some cases a pressure transient can be observed during a formation tester buildup test. Generally the buildup pressure transient is matched to a formation model to determine the formation permeability. But in many cases the buildup pressure transient has an additional transient that can be characterized due to supercharging. The formation models transient can be subtracted from the total pressure transient using the principle of superposition which leaves only the supercharge transient. Then using Equation 12 and 13 or a numerical model this supercharged pressure transient can be matched and mudcake properties and supercharging estimated.

The sixth method uses the fact that in drilling operations the borehole pressure can vary. For example the hydrostatic pressure can very over the duration of the pressure test as much as 100 psi. This pressure transient is transmitted thru the mudcake to the formation and can be detected by the FTWD tool. Again this pressure transient can be determined through superposition and used to estimate the mudcake properties. In this case Equations 12 and 13 can be used to match the supercharge pressure transient and estimate mudcake properties. Then using Equations 12 and 13 or other numerical methods. As in all previous cases a numerical model can be used in place of the equations.

The seventh method uses the mud pulses that exist when mud pumps are turned on during a pressure test. These mud pulses are transmitted through the mudcake and are detected by the formation tester during the buildup. Using Equations 12 and 18 the mudcake properties can be determined by matching the magnitude of these mud pulses. Then using Equations 12 and 13 or other numerical methods the supercharge pressure can be estimated.

Once the model for the supercharge pressure is created, the parameters of the model may be adjusted to match the pressures measured during the drawdown and/or build-up test taken with the test tool 10. These model parameters may then be used to determine the supercharge pressure and thus the formation pressure. For example, the supercharge pressure may be taken into account in the pressure measurements taken by the formation test tool 10 to determine the actual formation pressure ($P_f$).

In addition to determining the supercharge pressure for correcting the pressure test measurements, the test tool 10 may also be used to take multiple measurements after drilling a particular location in the formation 9 to determine the effects of supercharging over time as the filtrate enters the formation 9 and the mudcake 49 forms. Knowing the effects of supercharging over a period of time allows the testing tool 10 to optimize the pressure test procedure. For example, it may be determined that for a given formation 9, there is a length of time after recently drilling the borehole 8 where the supercharge pressure is low enough to not substantially affect the formation pressure measurements. The tool 10 may then be used to perform pressure tests within this time to minimize the effects of supercharge pressure on the pressure measurements. Performing the pressure tests before substantial supercharge pressure also allows the test tool 10 to draw in formation fluid without having to first draw in filtrate that has entered the formation 9. The multiple measurements of supercharge pressure may be performed at the same location within the borehole 8 or at different locations as desired.

The drilling fluid may also be redesigned in real time to optimize the drilling fluid properties depending on the measured supercharge pressure. For example, the density of the drilling fluid may be increased or decreased depending on the desired interaction between the mudcake 49 and the formation 9. The chemical properties of the drilling fluid may also be adjusted depending on how the drilling fluid interacts with the formation 9 so as to minimize the supercharge pressure. The drilling fluid properties may be changed to improve the sealing action of the mudcake (i.e., mudcake permeability) and speed the formation of the mudcake (i.e., mudcake compaction factor).

The formation test tool 10 may also use the supercharge pressure to adjust the measurements taken by other logging instruments. For example, the measurements taken by an electromagnetic wave resistivity logging sensor (EWR) are affected by the supercharge pressure on the formation extending into the formation, or supercharge pressure gradient. Once the supercharge pressure gradient is determined, the formation pressure gradient can be estimated using formation and mudcake properties. Then the depth of invasion can also be estimated. The measurements taken by the EWR may be adjusted to more accurately reflect the properties of the formation. The supercharge pressure gradient may also be used to correct any other sensor measurements that are affected by the supercharging pressure.

While specific embodiments have been illustrated and described, one skilled in the art can make modifications without departing from the spirit or teaching of this invention. The embodiments as described are exemplary only and are not limiting. Many variations and modifications are possible and are within the scope of the invention. Accordingly, the scope of protection is not limited to the embodiments described, but is only limited by the claims that follow, the scope of which shall include all equivalents of the subject matter of the claims.

What is claimed is:

1. A method of determining the supercharge pressure in a formation intersected by a borehole having a wall, the method comprising:

disposing a formation pressure test tool into the borehole, said formation pressure test tool comprising a probe for isolating a portion of the borehole;

extending said probe into sealing contact with the borehole wall;

performing at least one drawdown test with said formation pressure test tool by drawing formation fluid into a drawdown chamber of said formation pressure test tool and measuring fluid pressure in said drawdown chamber;

modeling the supercharge pressure of the formation using transient pressure effects caused by the dynamic properties of a mudcake formed on the borehole wall; and determining the supercharge pressure of the formation using said supercharge pressure model.

2. The method of claim 1 further comprising determining the pore pressure of the formation using said supercharge pressure.

3. The method of claim 1 further comprising determining formation and mudcake properties.

4. The method of claim 1 further comprising disposing said formation pressure test tool into the borehole on a drill string.

5. The method of claim 4 further comprising modeling the supercharge pressure of the formation using pressure transient effects caused by movement of the drill string.

6. The method of claim 4 further comprising modeling the supercharge pressure of the formation using pressure transient effects caused by pressure pulses in drilling fluid in the borehole.

7. The method of claim 1 further comprising determining the supercharge pressure using a processor.

8. The method of claim 1 further comprising performing at least one leak-off test with said formation pressure test tool.

9. The method of claim 1 further comprising determining the supercharge pressure while drilling fluid is flowing in the borehole.

10. The method of claim 1 wherein extending said probe into sealing contact with the borehole wall further comprises forming seal with the borehole wall through the mudcake.

11. The method of claim 1 further comprising repeating performing drawdown tests and determining the supercharge pressure over a period of time after the borehole intersects the formation.

12. The method of claim 11 further comprising determining when to perform a formation pressure test to minimize the effect of supercharge pressure on the formation.

13. The method of claim 11 further comprising repeating determining the supercharge pressure over a period of time at the same location.

14. The method of claim 11 further comprising repeating determining the supercharge pressure over a period of time at different locations.

15. The method of claim 11 wherein extending said probe into sealing contact with the borehole wall further comprises forming seal with the borehole wall through the mudcake.

16. The method of claim 1 further comprising adjusting the properties of the drilling fluid based on the supercharge pressure.

17. The method of claim 16 further comprising adjusting the properties of the drilling fluid to minimize the supercharge pressure.

18. The method of claim 16 further comprising adjusting the chemical properties of the drilling fluid.

19. The method of claim 16 further comprising adjusting the density of the drilling fluid.

20. The method of claim 16 further comprising adjusting the drilling fluid to improve the sealing action of the mudcake.

21. The method of claim 16 further comprising adjusting the drilling fluid to increase the rate of formation of the mudcake.

22. The method of claim 16 wherein extending said probe into sealing contact with the borehole wall further comprises forming seal with the borehole wall through the mudcake.

23. The method of claim 1 further comprising:

taking measurements with a logging while drilling sensor; and adjusting the measurements of said logging while drilling sensor based on the supercharge pressure.

24. The method of claim 23 further comprising determining the distribution of the filtrate invasion using the supercharge pressure model.

25. The method of claim 23 wherein said logging while drilling sensor compnses an electro-magnetic wave resistivity logging sensor.

26. The method of claim 23 wherein extending said probe into sealing contact with the borehole wall further comprises forming seal with the borehole wall through the mudcake.

* * * * *